US006619657B2

(12) United States Patent
Horikoshi et al.

(10) Patent No.: US 6,619,657 B2
(45) Date of Patent: Sep. 16, 2003

(54) CURL CORRECTION DEVICE, AND IMAGE FORMING APPARATUS HAVING THE CURL CORRECTION DEVICE

(75) Inventors: Jun Horikoshi, Shizuoka (JP); Kenji Suzuki, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 48 days.

(21) Appl. No.: 09/805,175

(22) Filed: Mar. 14, 2001

(65) Prior Publication Data

US 2001/0024013 A1 Sep. 27, 2001

(30) Foreign Application Priority Data

Mar. 14, 2000 (JP) ..... 2000-070428
May 12, 2000 (JP) ..... 2000-140134

(51) Int. Cl.[7] ..... B65H 29/70

(52) U.S. Cl. ..... 271/188
(58) Field of Search ..... 271/188

(56) References Cited

U.S. PATENT DOCUMENTS

| | | | | | |
|---|---|---|---|---|---|
| 5,153,662 | A | * | 10/1992 | Foos | 162/271 |
| 5,202,737 | A | * | 4/1993 | Hollar | 162/271 |
| 5,287,157 | A | * | 2/1994 | Miyazato et al. | 162/197 |
| 5,350,166 | A | | 9/1994 | Shimizu et al. | 271/14 |
| 5,392,106 | A | * | 2/1995 | Bigenwald et al. | 162/270 |
| 5,517,292 | A | * | 5/1996 | Yajima et al. | 271/900 |
| 5,555,083 | A | * | 9/1996 | Kuo et al. | 162/197 |
| 5,625,444 | A | | 4/1997 | Suzuki et al. | 399/400 |
| 5,674,019 | A | | 10/1997 | Munakata et al. | 400/568 |
| 5,729,816 | A | | 3/1998 | Matsumoto et al. | 399/381 |
| 5,774,204 | A | | 6/1998 | Suzuki et al. | 355/27 |
| 6,259,888 | B1 | * | 7/2001 | Kazama et al. | 271/183 |
| 6,375,181 | B1 | * | 4/2002 | Kawano et al. | 270/58.12 |
| 6,415,130 | B1 | * | 7/2002 | Fujiwara et al. | 271/188 |

FOREIGN PATENT DOCUMENTS

| | | | | |
|---|---|---|---|---|
| JP | 4-292365 | | | 10/1992 |
| JP | 406115791 | A | * | 10/1992 |
| JP | 4-338060 | | | 11/1992 |
| JP | 406144677 | A1 | * | 11/1992 |
| JP | 406144678 | A | * | 11/1992 |
| JP | 408143206 | A | * | 11/1994 |
| JP | 408165049 | A | * | 12/1994 |
| JP | 410029749 | A | * | 7/1996 |
| JP | 410087141 | A | * | 9/1996 |
| JP | 410114454 | A | * | 10/1996 |
| JP | 411029255 | A | * | 7/1997 |
| JP | 411255388 | A | * | 3/1998 |
| JP | 02000226149 | A | * | 2/1999 |
| JP | 11-268856 | | | 10/1999 |

* cited by examiner

*Primary Examiner*—Christopher P. Ellis
*Assistant Examiner*—Richard Ridley
(74) *Attorney, Agent, or Firm*—Fitzpatrick, Cella, Harper & Scinto

(57) ABSTRACT

A sheet conveying device includes an endless belt for conveying a sheet, at least two stretching shafts arranged to revolvably stretch the endless belt, a rotatable pressing roller arranged to push the stretched endless belt from outside, the sheet being arranged to be conveyed in a state of being pinched between the endless belt and the pressing roller, and springs for pressing the pressing roller so as to make the pressing roller movable in a direction of being pushed to the endless belt and in a direction of being released from being pushed to the endless belt. Further, a curled-sheet correction device includes an endless belt arranged to circulate in a state of being wrapped around a plurality of guide rollers, and at least one curl correction roller arranged to press the endless belt in such a direction as to narrow a circulating area of the endless belt, wherein, among the plurality of guide rollers, a driving guide roller to which a rotative driving force is imparted is formed to have a straight generatrix, and curl of a curled sheet is corrected while the curled sheet is conveyed jointly by the endless belt and the curl correction roller.

18 Claims, 15 Drawing Sheets

CURL CORRECTION DEVICE, AND IMAGE FORMING APPARATUS HAVING THE CURL CORRECTION DEVICE

BACKGROUND OF THE INVENTION

1. Field of the Invention

The present invention relates to a curl correction device for correcting the curl of a curled sheet, and to an image forming apparatus having the curl correction device, such as a copying machine, a printer, a facsimile apparatus or a composite apparatus composed of such apparatuses.

2. Description of Related Art

Image forming apparatuses, such as a copying machine, a printer, a facsimile apparatus, etc., which are arranged to form images on sheets have recently come to be popularly used. These apparatuses are forming images by various methods. Among the known image forming methods, an electrophotographic method whereby a toner image is transferred to and fixed on a sheet is widely employed. The electrophotographic-type image forming apparatus is provided with a thermal fixing device for fixing a toner image to a sheet after the toner image is transferred to the sheet. Further, since energy saving is vary important these days, a two-sided printing function is becoming indispensable to an image forming apparatus.

A laser beam printer of the electrophotographic type is described below, by way of example, as one of the conventional image forming apparatuses having the two-sided printing function, with reference to FIGS. 14 to 17.

As shown in FIG. 14, the conventional image forming apparatus includes, within an image forming apparatus body 1, sheet cassettes 20 each of which is arranged as a sheet housing part to allow sheets P stacked therein, an image forming part 2 which is arranged as an image forming means to form a toner image on a sheet P, and a fixing part 3 which is arranged to fix the toner image formed on the sheet P.

Further, the image forming apparatus is provided with a sheet conveying path 21 which is formed to extend from the sheet cassette 20 up to the image forming part 2, and a two-sided-print conveying path 4 which is arranged, as a sheet reconveying path, to feed the image forming part 2 again with the sheet P, after the sheet P has passed the fixing part 3, for the purpose of printing on both sides of the sheet P. Further, on the downstream side of the fixing part 3, there are provided a sheet delivery path 6 for delivering a sheet P to the outside of the apparatus, and a sheet inverse conveying path 7 for leading the sheet P to the two-sided-print conveying path 4. These conveying paths 6 and 7 are arranged in such a way as to fork away from each other.

Conveying path change-over levers (not shown) are arranged respectively at a fork point between the sheet delivery path 6 and the sheet inverse conveying path 7 and at a confluence point between the sheet inverse conveying path 7 and the two-sided-print conveying path 4. The sheet conveying paths are arranged to be switched from one path over to another by these conveying path change-over levers under control signals from control means (not shown) which is arranged to control the whole image forming apparatus.

Each of the sheet conveying paths is provided with pairs of conveying rollers 22 for conveying the sheet. A pickup roller 23 is arranged to pick up from each of the sheet cassettes 20 a sheet P which is located uppermost among the sheets P stacked at the sheet cassette 20. A pair of registration rollers 24 are arranged to intermittently feed a transfer part 5 of the image forming part 2 with the sheets P at a predetermined timing. A pair of delivery rollers 25 are arranged to discharge and deliver to the outside a sheet P having passed through the fixing part 3. A belt conveyer part 26 is composed of a plurality of belts and a plurality of pulleys which are arranged to feed the fixing part 3 with a sheet P after an image is formed on the sheet P through the image forming part 2.

In the image forming apparatus, a sheet P which is located uppermost among the sheets P stacked at each of the sheet cassettes 20 is picked up by the pickup roller 23. The sheet P picked up is transported along the sheet conveying path 21 by the conveying roller pairs 22 which are disposed after the pickup roller 23. With the sheet P transported in this manner, the registration roller pair 24 intermittently feeds the transfer part 5 of the image forming part 2 with the sheet P. After a toner image is transferred to the upper surface of the sheet P by the transfer part 5, the sheet P is conveyed to the fixing part 3 by means of the belt conveyer part 26.

At the fixing part 3, the sheet P is heated and pressed to have the toner image fixed thereto. In the case of ordinary printing only on one side of the sheet P, the sheet P is discharged and delivered to the outside by the delivery roller pair 25 after the fixing process.

In a case where the apparatus is used for printing on both sides of the sheet P, on the other hand, the sheet P having passed through the fixing part 3 is led by the conveying path change-over lever (not shown) to the sheet inverse conveying path 7 which branches downward after the fixing part 3. While the sheet P is on the movement from the sheet inverse conveying path 7 to the two-sided-print conveying path 4, the moving direction of the sheet P is reversed to move the sheet P further on the two-sided-print conveying path 4 in a state of having its image-formed side facing upward. Then, the sheet P is shifted from the two-sided-print conveying path 4 again to the sheet conveying path 21. On the sheet conveying path 21, the main surface side of the sheet P is inverted to have its image-formed side facing upward. In this state, the sheet P is intermittently conveyed to the transfer part 5 of the image forming part 2. After a toner image is transferred to the upper surface of the sheet P, the sheet P is subjected to the toner image fixing process at the fixing part 3 and is then delivered to the outside by the delivery roller pair 25.

The electrophotographic image forming apparatus has a problem in that the sheet P is curled by heat when the sheet P passes through the fixing part 3. This is called heat curl. After heating by the fixing device 3, the sheet P is curled also while it is passing through a bent part A or B of the conveying path. In a case where the sheet P comes to the two-sided-print conveying path 4, the upper side (image-formed surface) of the sheet P tends to be curled into an upward protruding shape, as shown in FIG. 17. In a case where the image forming apparatus is used for printing on two sides of the sheet P, in order to prevent inadequate image transfer, the curl must be removed before the sheet P is fed to the image forming part 2. To meet this requirement, as shown in FIG. 14, a curl correction mechanism 200 is arranged on the two-sided-print conveying path 4 to correct the protruding curl by retrorsely imparting a curl to the sheet P in the reverse direction.

The curl correction mechanism 200 includes, as shown in FIG. 16, an endless belt 214 arranged to convey the sheet P, stretching shafts 211 and 212 arranged to revolvably stretch the endless belt 214, and a pressing roller 213 which is rotatively arranged to push the stretched endless belt 214 from outside. The curl correction mechanism 200 is thus arranged to convey the sheet P in a state of having the sheet P sandwiched or pinched between the endless belt 214 and the pressing roller 213.

At the curl correction mechanism 200, the sheet P is caused to pass through a path formed approximately in a V shape jointly by the endless belt 214 and the pressing roller 213 of the curl correction mechanism 200 shown in FIGS. 14 and 16. By this arrangement, the upward curl of the sheet P is corrected to prevent inadequate image transfer to the second surface of the sheet P.

The conventional image forming apparatus arranged as described above has presented a problem in the following point.

If the retrorse curl imparted to the sheet P is too strong, the curl correction becomes excessive to bring forth a downward protruding curl. In carrying out the image transfer for the second time through the two-sided-print conveying path 4 under such a condition, a protruding curl arises in such a way as to have the second transfer surface of the sheet P away from the main surface of the transferring photosensitive drum 2*a,* as shown in FIG. 15. Then, the second transfer tends to be inadequately carried out. To prevent this, the retrorse curling amount to be imparted to the sheet P must be set at an apposite degree at the curl correction mechanism 200. Heretofore, the degree of curl and that of the retrorse curl have been set by using, as a standard, a normal paper sheet (measuring 52 to 90 g/m$^2$ in basis weight).

Meanwhile, in recent years, the number of kinds of sheet materials desired to be useable by image forming apparatuses has increased. Particularly, a desire to use a thick paper sheet measuring 100 g/m$^2$ or more in basis weight (hereinafter referred to as the thick sheet) has become strong.

However, the normal sheet (measuring 52 to 90 g/m$^2$ in basis weight) and the thick sheet (measuring 100 g/m$^2$ and more in basis weight) differ in curling amount even if they are in the same sheet size and even when they are allowed to pass through the same fixing device and the same bent parts of the conveying paths. Hence, two-sided printing on the thick sheet has often become difficult.

In other words, unlike the normal sheet, the thick sheet does not curl upward but rather remains flat or curls somewhat downward on the two-sided-print conveying path 4. It is, therefore, unnecessary to make curl correction by using the curl correction mechanism 200. However, the curl correction mechanism 200 of the conventional image forming apparatus is arranged without taking the use of the thick sheet into consideration but is arranged to make curl correction appositely only to the normal sheet. Hence, when the thick sheet is allowed to pass through the curl correction mechanism 200, the curl correction causes the thick sheet to curl downward too much and thus tends to cause the fore end of the sheet to strongly abut on the main surface of the transferring photosensitive drum 2*a*. Such a condition has sometimes caused an inadequate image transfer (image deviation) or jamming of paper.

It is conceivable to solve this problem by adjusting the amount of ingression of the pressing roller 213 on the endless belt 214 according to the thickness of the sheet. However, such adjustment necessitates the use of a means for detecting the thickness of the sheet and a means for changing the ingression amount of the pressing roller 213 from one amount to another amount, and thus inevitably increases the cost and size of the image forming apparatus.

Meanwhile, among image forming apparatuses of varied kinds, printers and copying machines which are electrophotographically arranged to be capable of outputting full color images have come to be popularly used. FIG. 18 shows, by way of example, the arrangement of a printer 140 which is of that kind.

As shown in FIG. 18, the printer 140 is arranged to read an original at a reader part 102 provided on the upper part of the printer body 101. Information obtained by the reader part 102 is used to form toner images of yellow, magenta, cyan and black colors on photosensitive drums 5Y, 5M, 5C and 5Bk which are provided for these colors at an image recording part 104. The toner images of these colors are transferred one on top of another to a sheet supplied from a sheet supply part 103. The toner images of the different colors are fixed to the sheet, and, then, the sheet is delivered to a sorter 127, by a fixing-delivery part 106.

Demands have recently increased for arranging an image forming apparatus in combination with some post-processing apparatus, such as a sorter arranged to sort the image-formed sheets by a desired number of sheets, a stapler arranged to staple a sheet bundle, a puncher arranged to punch a hole or holes in the sheet, a finisher arranged to permit sheets to be stacked up in a larger quantity, or the like. Particularly, a demand is becoming high for arranging printers to permit selective use of a back-side sheet delivering function whereby each sheet is delivered in a state of having its image-formed side facing downward.

Compared with an image forming apparatus of the ordinary type, an image forming apparatus having such an post-processing apparatus is more apt to be affected by the size and direction of the curl of a sheet. Excessively curled sheets tend to cause inadequate stacking, inadequate matching, imperfect stapling, etc.

To solve that problem, the printer 140 shown in FIG. 18 has a curled-sheet correction device 126 for correcting a curled sheet disposed on the upstream side of the post-processing apparatus.

The curled-sheet correction device 126 has a curled-sheet correction part 130 which is arranged as shown in FIG. 19. As shown FIG. 19, the curled-sheet correction part 130 includes a sponge roller 128 and a metal roller 129. The sponge roller 128 is made with a sponge layer 128*b* and a rubber layer 128*c* formed around a metal core bar 128*a*. The metal roller 129 is urged in the direction of an arrow F to be pushed somewhat into the sponge roller 128 to form a nip part there.

Each of these rollers 128 and 129 is driven to rotate in the direction of arrows by a drive source (not shown). An upward curled sheet, i.e., a sheet having its two ends curled upward, is corrected to have a horizontal surface by imparting a downward curl to its upward curled ends when the sheet comes into the nip part from the direction of an arrow P.

However, the conventional curled-sheet correction device 126 tends to bring about a slip if a rotative driving force is applied to the metal roller 129, because a frictional force on the sheet is small. The occurrence of such a slip tends to make the sheet conveying speed unstable. If a rotative driving force is applied to the sponge roller 128, on the other hand, the outside diameter of the sponge roller 128 comes to vary to make also the sheet conveying speed unstable, because the sponge part of the sponge roller 128 is deformed by being pushed.

Besides, in a case where the post-processing apparatus, such as a stapler, a puncher, or the like, is disposed on the downstream side of the curled-sheet correction device 126, if the timing of feeding the post-processing apparatus with the sheets, or the conveying speed, is inaccurate, the inaccurate timing might cause jamming or the like to take place on a conveying path located on the downstream side of the curled-sheet correction device 126.

To avoid such a trouble, the conventional curled-sheet correction device 126 is arranged to finely adjust the sheet conveying speed of the curled-sheet correction part 130 or to adjust the sheet conveying speed by arranging an additional pair of rollers on the downstream side. However, such an arrangement makes it necessary to provide an additional control device for controlling the sheet conveying speed. The provision of such an additional control device has caused the curled-sheet correction device 126 to have a complex structure and an increased size.

Further, the curled-sheet correction device 126 has presented another problem in that, in order to make the curled-sheet correction device 126 capable of correcting a larger amount of curl, the amount of pushing the metal roller 129 into the sponge roller 128 must be increased. However, the increased pushing amount would cause the input torque of the above-stated rotative driving force to increase, and thus would cause an increase in cost of the curled-sheet correction device 126.

BRIEF SUMMARY OF THE INVENTION

It is an object of the invention to provide a sheet conveying device which is arranged to be capable of correcting the curl of sheets according to the thickness of the sheets, without incurring any increase in cost and size of the sheet conveying device, and also to provide an image forming apparatus having the sheet conveying device.

It is another object of the invention to provide a curled-sheet correction device simply arranged to be capable of reliably correcting the curl of curled sheets and also to provide an image forming apparatus having the curled-sheet correction device.

To attain the above objects, in accordance with a first aspect of the invention, there is provided a sheet conveying device, comprising an endless belt for conveying a sheet, at least two stretching shafts arranged to revolvably stretch the endless belt, a rotatable pressing roller arranged to push the stretched endless belt from outside, the sheet being arranged to be conveyed in a state of being pinched between the endless belt and the pressing roller, and pressing means for pressing the pressing roller so as to make the pressing roller movable in a direction of being pushed to the endless belt and in a direction of being released from being pushed to the endless belt.

Further, in the sheet conveying device, the pressing means is an elastic member arranged to press a rotation shaft of the pressing roller.

Further, in the sheet conveying device, the elastic member is provided at each of two ends of the rotation shaft of the pressing roller.

Further, in the sheet conveying device, an angle a which upstream-side and downstream-side sheet conveying surfaces of the endless belt formed with the pressing roller taken as a boundary therebetween make with each other is within the following range:

$$2\pi/6(\text{rad}) \leqq \alpha \leqq 5\pi/6(\text{rad}).$$

Further, in the sheet conveying device, the pressing roller is located adjacent to an intersection point at which an upstream-side conveying path and a downstream-side conveying path are connected to each other.

Further, in the sheet conveying device, an angle $\beta$ which the pressing roller, the endless belt and the stretching shafts make with each other is an angle bending in the same direction as the angle $\alpha$, and the angle $\alpha$ and the angle $\beta$ are in a relation satisfying the following condition:

$$\beta=\alpha\pm\pi/6.$$

Further, an image forming apparatus comprises the above-stated sheet conveying device, and image forming means for forming an image on a sheet conveyed by the sheet conveying device.

In addition, the image forming apparatus further comprises a sheet housing part arranged to allow sheets to be stacked therein, a sheet conveying path formed from the sheet horsing part up to the image forming means, and a sheet resupply path arranged to supply to the image forming means again a sheet having an image formed thereon by the image forming means, wherein the above-stated sheet conveying device is disposed on the sheet resupply path.

Further, in the image forming apparatus, the sheet resupply path has one end on a downstream side thereof connected to the sheet conveying path.

Further, in the image forming apparatus, the sheet resupply path is provided with sheet inverting means for inverting a traveling direction of the sheet having an image formed thereon by the image forming means.

Further, to attain the above objects, in accordance with a second aspect of the invention, there is provided a curled-sheet correction device, comprising an endless belt arranged to circulate in a state of being wrapped around a plurality of guide rollers, and at least one curl correction roller arranged to press the endless belt in such a direction as to narrow a circulating area of the endless belt, wherein, among the plurality of guide rollers, a driving guide roller to which a rotative driving force is imparted is formed to have a straight generatrix, and curl of a curled sheet is corrected while the curled sheet is conveyed jointly by the endless belt and the curl correction roller.

Further, in the curled-sheet correction device, the curl correction roller is arranged to press a tension side of the endless belt.

Further, in the curled-sheet correction device, the curl correction roller is arranged to press a tension side of the endless belt, and the driving guide roller is disposed on a most downstream side in a direction in which the sheet is conveyed.

Further, in the curled-sheet correction device, among the plurality of guide rollers, a driven guide roller arranged to be driven to rotate has a larger diameter at a middle part thereof than at two end parts thereof.

Further, an image forming apparatus comprises image forming means for forming an image on a sheet, and the above-stated curled-sheet correction device arranged to remove curl of the sheet having an image formed thereon by the image forming means.

Further, an image forming apparatus comprises image forming means for forming an image on a sheet, two-sides inverting means for inverting two sides of the sheet having an image formed thereon by the image forming means and then discharging the sheet, and the above-stated curled-sheet correction device disposed at the two-sides inverting means.

The above-stated endless belt is arranged to circulate by the rotation of the guide rollers. In this instance, the endless belt circulates under the pressure of the curl correction roller. Therefore, a part of the endless belt where the endless belt is pressed by the curl correction roller is flexibly bent in the direction of narrowing the area of circulation of the endless belt. The sheet is allowed to pass between the curl correction roller and the bent part of the endless belt. The curl of the sheet is corrected through the flexibly bent part of the endless belt. Besides, since the generatrix of the driving guide roller is arranged to be straight, the revolving speed of the endless belt never fluctuates. The endless belt is thus arranged to be capable of conveying the sheet exactly at a desired speed.

With the curl correction roller arranged to press the tension (stretching) side of the endless belt, the inward pressing (ingression) amount of the curl correction roller on the endless belt little varies even when the ingression of the sheet in between the curl correction roller and the endless belt causes variations in load. Therefore, the endless belt can convey the sheet at an approximately constant speed.

With the curl correction roller arranged to press the stretching (tension) side of the endless belt and the driving guide roller disposed at the most downstream part, the rectilinear recovering tendency of the bent part of the endless belt under the pressure of the curl correction roller is strong. The strong recovering tendency effectively acts to minimize the fluctuations of the inward pressing amount of the curl correction roller on the endless belt even when the ingression of the sheet in between the curl correction roller and the endless belt causes variations in load. Therefore, the sheet conveying speed of the endless belt is approximately constant.

The driven guide roller which is driven to rotate among the plurality of guide rollers is arranged to have the diameter of its middle part set to be larger than the diameters of its two end parts. By virtue of this arrangement, when the endless belt trends toward the end part of the driven guide roller while the endless belt is circulating, the endless belt is prevented from coming off the guide rollers, because the endless belt is then moved toward the middle part, which has a larger diameter.

The above and further objects and features of the invention will become apparent from the following detailed description of preferred embodiments thereof taken in connection with the accompanying drawings.

DETAILED DESCRIPTION OF THE INVENTION

Hereinafter, preferred embodiments of the invention will be described in detail with reference to the drawings.

Figure 1:
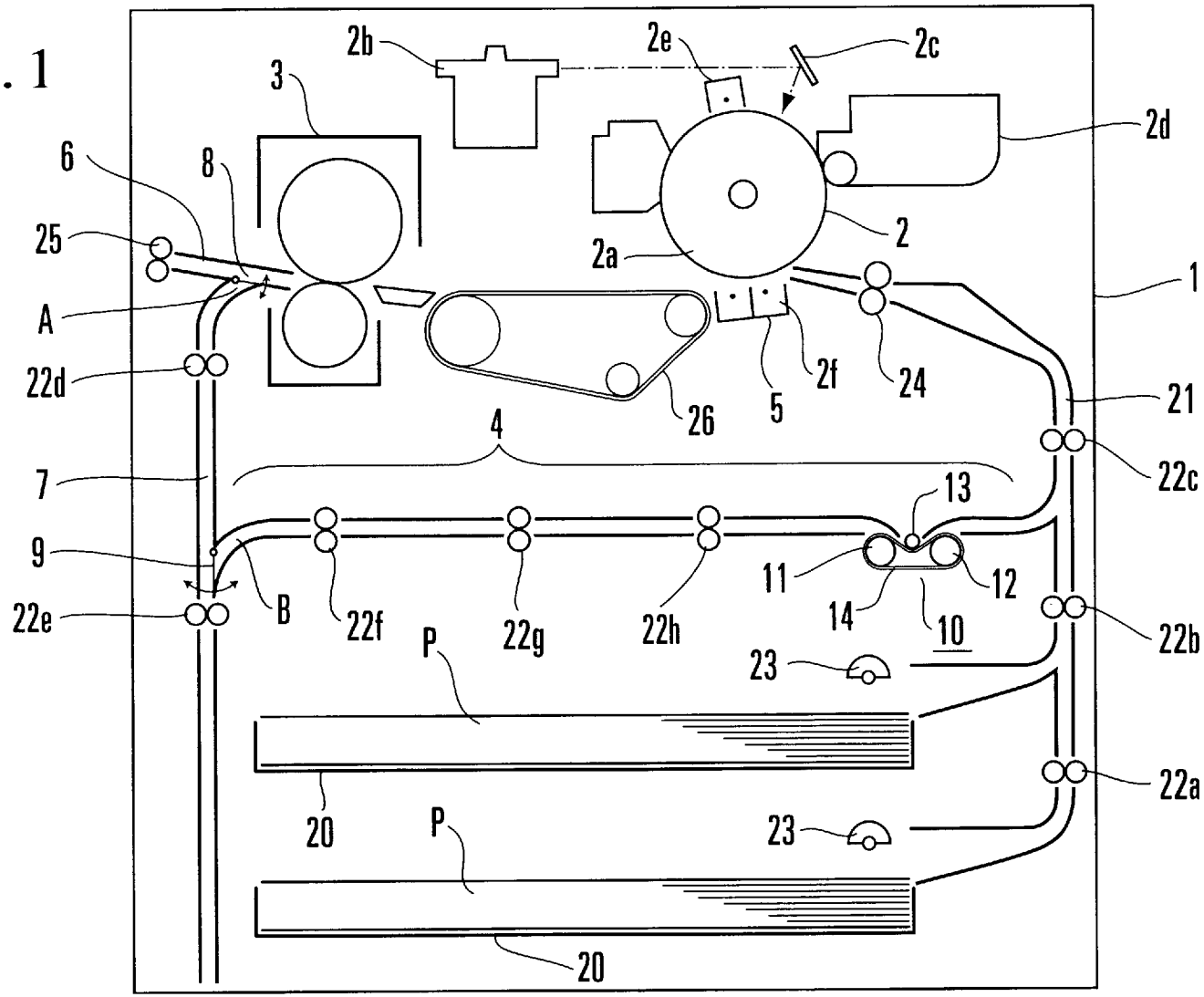
FIG. 1 is a sectional view showing the whole arrangement of an image forming apparatus according to a first embodiment of the invention.
Figure 2:
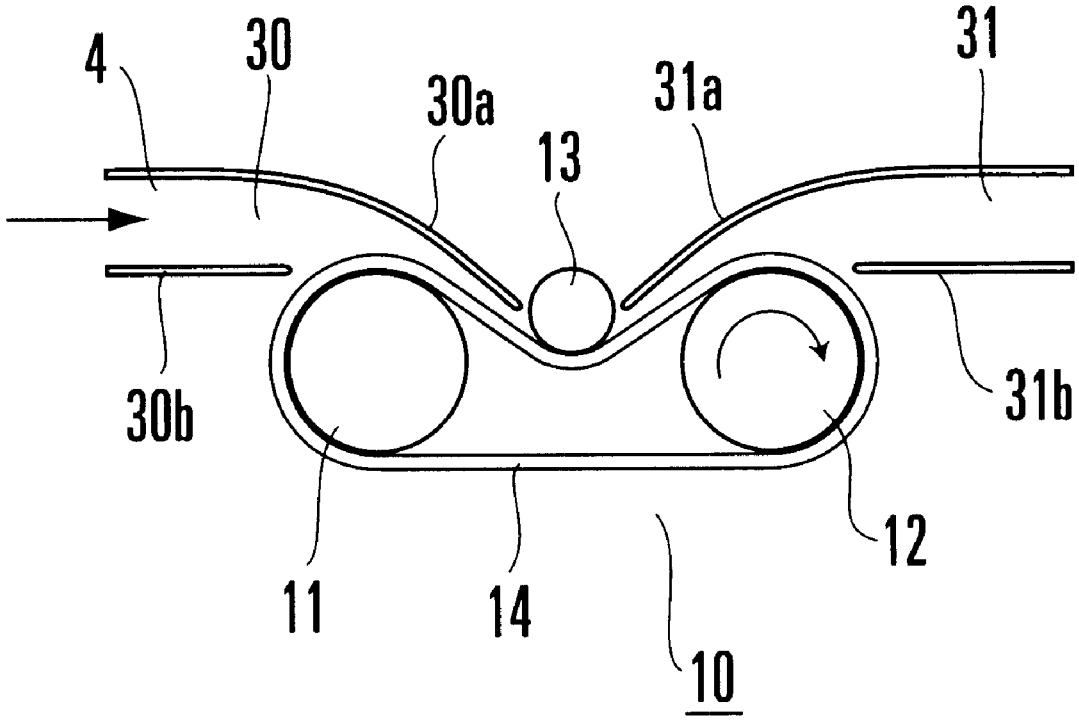
FIG. 2 is a sectional view showing the structural arrangement of a curl correction means in the image forming apparatus shown in FIG. 1.
Figure 3:
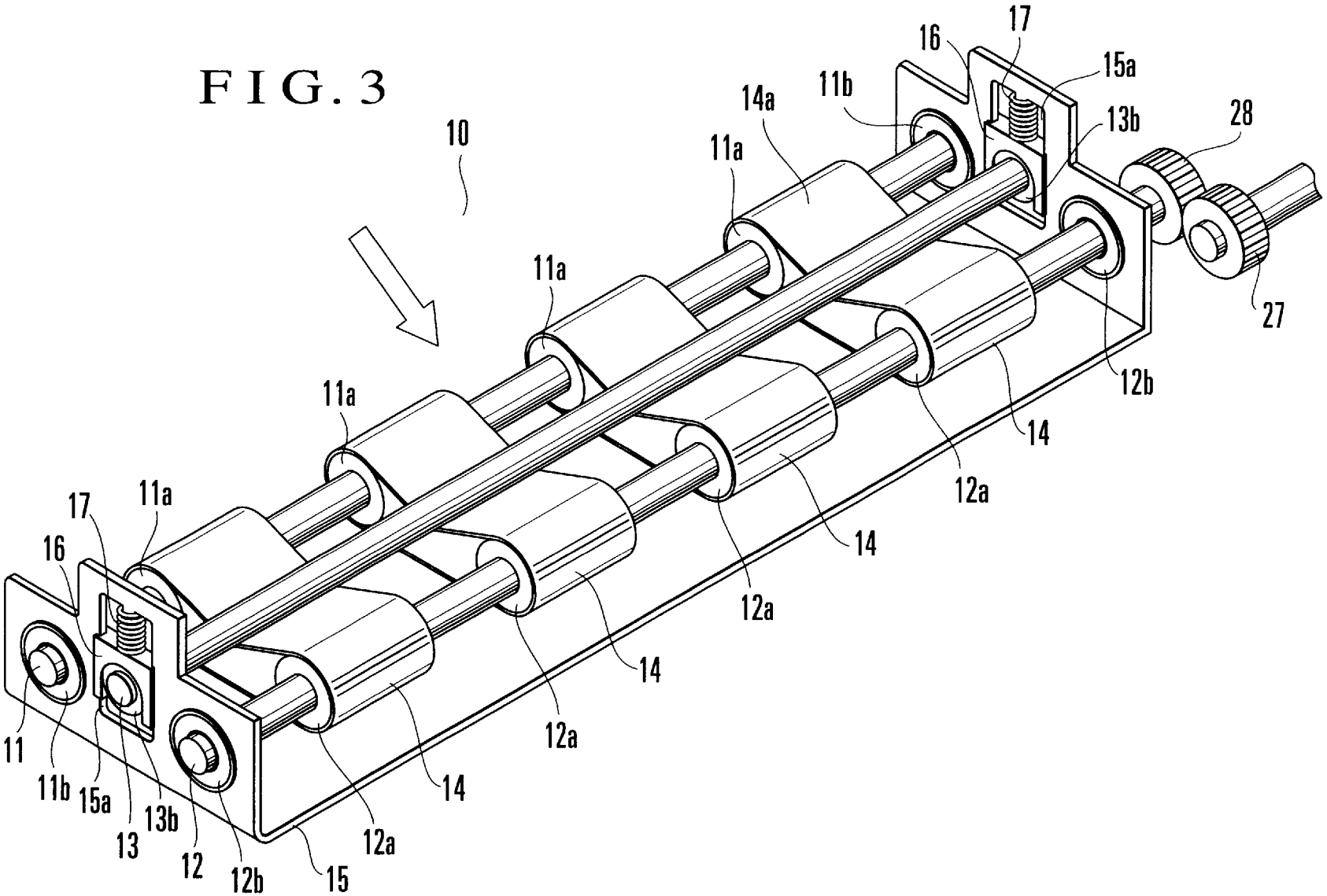
FIG. 3 is a perspective view showing in detail the structural arrangement of the curl correction means shown in FIG. 2.

A first embodiment of the invention is first described referring to FIGS. 1 to 3. In FIGS. 1 to 3, all parts of the first embodiment that are the same as those of the conventional example shown in FIG. 14 to 17 are denoted by the same reference numerals, and the details of them are omitted from the following description.

FIG. 1 shows the whole arrangement of an image forming apparatus having a sheet conveying device to which the invention is applied. In the case of the first embodiment, the image forming apparatus is a laser beam printer which operates by the electrophotographic method. As shown in FIG. 1, the image forming apparatus body 1 contains therein sheet cassettes 20 which are arranged as a sheet housing part to permit sheets P to be stacked there, an image forming part 2 which is arranged as an image forming means to form a toner image on the sheet P, and a fixing part 3 which is arranged to fix the toner image formed on the sheet P.

The image forming apparatus is provided with a sheet conveying path 21 which is formed to extend from the sheet cassette 20 up to the image forming part 2, and a two-sided-print conveying path 4 which is arranged, as a sheet reconveying path, to feed the image forming part 2 again with the sheet P, after the sheet P has passed through the fixing part 3, for the purpose of printing on both sides of the sheet P. Further, on the downstream side of the fixing part 3, there are provided a sheet delivery path 6 for delivering the sheet P to the outside of the apparatus, and a sheet inverse conveying path 7 for leading the sheet P to the two-sided-print conveying path 4. The paths 6 and 7 are arranged in such a way as to fork away from each other. A conveying path changeover lever 8 is arranged at a fork point between the sheet delivery path 6 and the sheet inverse conveying path 7.

Another conveying path change-over lever 9 is arranged at a confluence point between the sheet inverse conveying path 7 and the two-sided-print conveying path 4. The sheet conveying paths are arranged to be switched from one path over to another with the conveying path change-over levers 8 and 9 operated under control signals from a control means (not shown) which is arranged to control the whole image forming apparatus. Each of the conveying path change-over levers 8 and 9 performs switching from one path over to another and is arranged to be swung by a solenoid or the like in the directions of arrows as shown in FIG. 1.

Each of the sheet conveying paths is provided with pairs of conveying rollers 22 (22*a* to 22*h*) for conveying the sheet. A pickup roller 23 is arranged to pick up from the sheet cassette 20 a sheet P which is located uppermost among the sheets P stacked at the sheet cassette 20. A pair of registration rollers 24 are arranged to feed a transfer part 5 of the image forming part 2 intermittently with the sheets P at a predetermined timing. A pair of delivery rollers 25 are arranged to discharge and deliver to the outside of the apparatus a sheet P which has passed through the fixing part 3. A belt conveyer part 26 is composed of a belt and a plurality of pulleys, which are arranged to feed the fixing part 3 with the sheet P after an image is formed on the sheet P through the image forming part 2.

The image forming part 2 is provided with an electrophotographic photosensitive drum 2*a* (hereinafter referred to simply as the photosensitive drum) which is arranged as an image bearing body to have an electrostatic latent image electrophotographically formed thereon, a laser scanner 2*b* which is arranged to form a latent image on the photosensitive drum 2*a,* a reflection mirror 2*c,* a developer 2*d,* a primary charger 2*e* arranged to electrify the photosensitive drum 2*a,* a transfer charger 2*f,* etc. At the image forming part 2, the surface of the photosensitive drum is supplied with laser beams corresponding to image information obtained by the emitting and scanning action of the laser scanner 2*b*. By this, a latent image is formed on the surface of the photosensitive drum 2*a,* which is uniformly electrified and charged by the primary charger 2*e*. Then, a toner image is formed with the latent image developed by the developer 2*d*.

The toner image is transferred onto the first surface of the sheet P by the transfer charger 2*f,* which is disposed below the photosensitive drum 2*a,* when the sheet P is conveyed by the registration roller pair 24 in synchronism with the rotation of the photosensitive drum 2*a*. The sheet P to which the toner image has been transferred is conveyed to the fixing part 3 by the belt conveying part 26 disposed in the middle part of the apparatus. With the sheet P thus conveyed to the fixing part 3, the toner image on the surface of the sheet P is fixed through a heating-and-pressing fixing process of the fixing part 3.

In the case of printing only on one side of the sheet P, each of the sheets P after the fixing process passes through the sheet delivery path 6 to be delivered by the delivery roller pair 25 to the outside of the image forming apparatus body 1 with the image-formed surface thereof facing upward. Then, the sheets P are discharged and stacked one by one on a delivery tray (not shown). In this case, the conveying path change-over lever 8 is kept in its initial position as shown in FIG. 1.

On the other hand, in the case of printing on both sides of the sheet P, the sheet P is fed again to the image forming part 2 in the following manner. More specifically, in a case where the apparatus is used for printing on both sides of the sheet P, on the other hand, the conveying path change-over lever 8 is caused to swing upward as viewed in FIG. 1 to close the sheet delivery path 6. With the delivery path 6 thus closed, each sheet P that has passed through the fixing part 3 is led toward the sheet inverse conveying path 7. Each of the sheets P is transported to the inside of the sheet inverse conveying path 7 by the conveying roller pairs 22*d* and 22*e*. When the rear end of the sheet P passes through the conveying path change-over lever 9, the conveying path change-over lever 9 swings clockwise from its initial position shown in FIG. 1 to close the sheet inverse conveying path 7. Then, the conveying roller pair 22*e* is caused to reversely rotate to move the sheet P upward, so that the traveling direction of the sheet P is inverted. After that, the sheet P is led to the two-sided-print conveying path 4 in a state of having its image-formed side facing upward. Then, the sheet P is fed by the conveying roller pairs 22*f,* 22*g* and 22*h* to the curl correction means 10. After curl correction, the sheet P is led to the sheet conveying path 21 to be fed again to the image forming part 2 through the conveying roller pair 22*c* and the registration roller pair 24. At this time, the sheet P has its image-formed side facing downward to have an image formed on its upper surface by the image forming part 2. The image formed on the upper surface of the sheet P is fixed through the fixing process at the fixing part 2. After the fixing process, the sheet P is allowed to pass through the sheet delivery path 6 to be delivered to the outside of the image forming apparatus body 1 by the delivery roller pair 25 in the above-stated manner.

The curl correction means 10 of the image forming apparatus according to the first embodiment is disposed on the downstream side of the two-sided-print conveying path 4, as shown in FIG. 1. The details of the curl correction means 10 are described with reference to FIGS. 2 and 3.

The curl correction means 10 includes, as shown in FIG. 2, an endless belt 14 arranged to convey the sheet P, a driven belt shaft 11 and a driving belt shaft 12 which are arranged as stretching shafts or as supporting rotary members to revolvably stretch the endless belt 14, and a pressing roller 13 which is rotatively arranged as a pinching rotary member to press the stretched endless belt 14 from above. At the curl correction means 10, when the driving belt shaft 12 is driven by some driving means such as a motor or the like (not shown) to rotate clockwise as viewed in FIG. 2, the endless belt 14 revolves and the driven belt shaft 11 rotates in the same direction. Then, the pressing roller 13, which is in pressed contact with the endless belt 14, is caused to rotate counterclockwise.

As shown in FIG. 2, a part of the two-sided-print conveying path 4 where the driven belt shaft 11 and the driving belt shaft 12 are disposed is formed by cutting lower guide members 30*b* and 31*b* located on the lower side among guide members which form the two-sided-print conveying path 4, while guide members 30*a* and 31*a* are bent in the direction of the pressing roller 13. Hereinafter, a part of the two-sided-print conveying path 4 on the upstream side of the pressing roller 13 will be referred to as an upstream-side conveying path 30, and another part on the downstream side as a downstream-side conveying path 31.

The curl correction means 10 is next described in detail referring to FIG. 3. The curl correction means 10 is formed in the following manner. As shown in FIG. 3, the driven belt shaft 11, the driving belt shaft 12 and the pressing roller 13 each are longer than the width of the sheet P and are mounted on a frame 15. A plurality of endless belts 14 (four belts in the case of the first embodiment) are mounted on the driven belt shaft 11 and the driving belt shaft 12. Each of the endless belts 14 is wrapped around belt conveying rollers

11*a* and 12*a* which are formed respectively integrally with the driven belt shaft 11 and the driving belt shaft 12. The endless belts 14 are preferably made of a rubber material such as CR, EPDM, polyurethane, or the like. The number of the endless belts 14 used in the first embodiment is four. However, the invention is not limited to this number.

The two end parts of the frame 15 where the driven and driving belt shafts 11 and 12 and the pressing roller 13 are mounted are formed in a bent-up shape (hereinafter referred to as the two side plates). The driven belt shaft 11, the driving belt shaft 12 and the pressing roller 13 are mounted on the two side plates of the frame 15 respectively in a rotatable manner.

More specifically, the driven belt shaft 11 and the driving belt shaft 12 are mounted on the two side plates of the frame 15 through bearings 11*b* and 12*b* which are ball bearings or slide bearings. The driving belt shaft 12 has a driving gear 28 mounted on its one end. The driving gear 28 is in mesh with a driving gear 27 to which a driving force of a driving means (not shown) is arranged to be transmitted. The driving belt shaft 12 is thus arranged to be rotatively driven by the driving means.

The pressing roller 13 is arranged to press each of the endless belts 14 under an urging force of a coiled spring 17 which is employed as an elastic member. The endless belt 14 is thus caused to warp along the peripheral surface of the pressing roller 13. More specifically, the pressing roller 13 measures ϕ8 in outside diameter and is made of free-cutting steel or stainless steel. The pressing roller 13 is supported by bearings 13*b*, each of which is a ball bearing or a slide bearing, and also pressing-roller holding members 16, which hold the bearings 13*b*. The holding members 16 are arranged to be capable of moving up and down within cutout parts 15*a* formed in the two side plates of the frame 15. The coiled spring 17 is disposed above each of the holding members 16. With the holding members 16 urged downward by the urging force of the coiled springs 17, the pressing roller 13 individually presses the endless belts 14 from the two end sides thereof. The pressing roller 13 is then pushed up by a reaction force resulting from the tension of each of the endless belts 14. The pressing roller 13 is thus held at a position where the urging force of the coiled springs 17 and the tension of the endless belts 14 are on the balance.

In conveying the sheet P, the curl correction means 10 operates as follows. When the sheet P is led to the two-sided-print conveying path 4 for two-sided printing, the sheet P is supplied to the curl correction means 10 by the conveying roller pairs 22*f*, 22*g* and 22*h*.

At the curl correction means 10, the sheet P is moved in the direction of an arrow shown in each of FIGS. 2 and 3, and, then, the lower portion of the fore end of the sheet P rides onto the main surface part 14*a* of each endless belt 14 on the driven belt shaft 11, which is revolving, so that the sheet P is conveyed by the endless belts 14. At this time, the sheet P is caused to move along the upper guide member 30*a*, which is slanting downward. The fore end part of the sheet P is thus supplied to a nip part between the pressing roller 13 and the endless belt 14 to be conveyed further by the main surface (hereinafter referred to as the sheet conveying surface) of each endless belt 14. The sheet P thus passes through the curl correction means 10. By passing the V sectional shape part of the sheet conveying surface of each endless belt 14 formed across the pressing roller 13 between the upstream and downstream sides of the sheet conveying surface, a curled state of the sheet P is corrected according to the angle of the V sectional shape. After passing through the curl correction means 10, the sheet P is led to the sheet conveying path 21 to be supplied again to the image forming part 2 through the conveying roller pair 22*c* and the registration roller pair 24.

Figure 4:
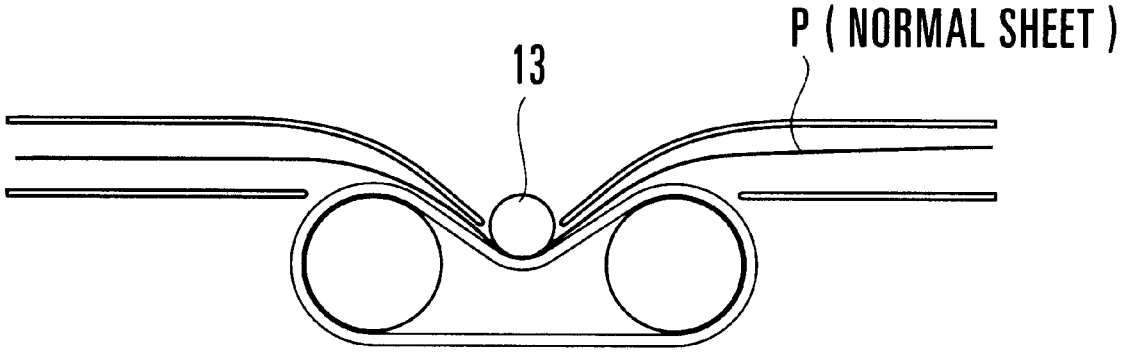
FIG. 4 is a diagram showing the state in which a normal sheet passes through the curl correction means shown in FIG. 2.
Figure 5:
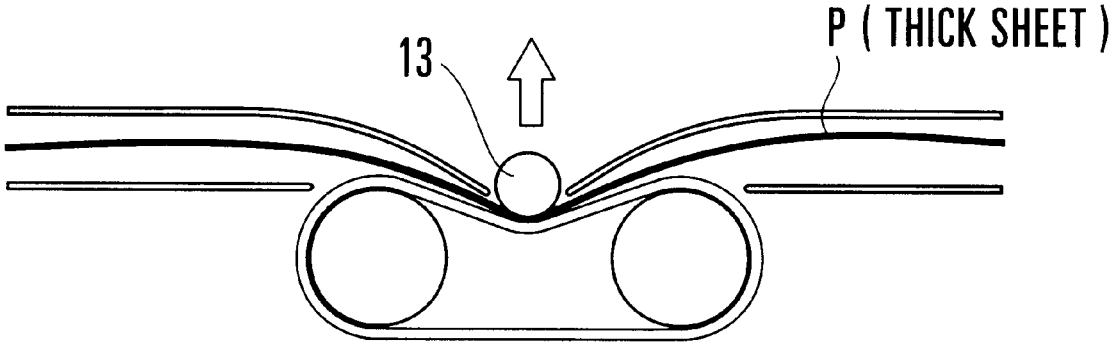
FIG. 5 is a diagram showing the state in which a thick sheet passes through the curl correction means shown in FIG. 2.

In the curl correction means 10 in the first embodiment, the pressing roller 13 is held at a position where the urging force of the coiled springs 17 and the tension of the endless belts 14 are balanced with each other as mentioned above. Therefore, the pressing roller 13 moves in the vertical direction when the sheet P passes there. More specifically, as shown in FIGS. 4 and 5, the pressing roller 13 moves up and down according to the value of reaction force of the sheet P. In a case where the sheet P is the normal sheet, the pressing roller 13 little moves as shown in FIG. 4. If the sheet P is the thick sheet, which is thicker than the normal sheet, on the other hand, the pressing roller 13 moves upward as shown in FIG. 5 as the reaction force of the sheet P is larger in the case of the thick sheet than in the case of the normal sheet.

In the case of the first embodiment, the coiled spring 17 of the curl correction means 10 has an urging force which is smaller than the reaction force of the thick sheet and is larger than that of the normal sheet. In a case where the sheet P is the normal sheet, a curl correcting function takes effect when the sheet P passes through the nip part between the endless belt 14 and the pressing roller 13, as shown in FIG. 4. If the sheet P is the thick sheet, the pressing roller 13 is caused to retreat upward by the reaction force or the rigidity of the thick sheet, as shown in FIG. 5, and the curl correcting function little takes effect.

Therefore, with the curl correction means 10 arranged in this manner, the image forming apparatus according to the first embodiment is capable of adequately making curl correction for both the normal sheet and the thick sheet.

In the case of the first embodiment, the curl correction is adequately made both for the normal sheet and for the thick sheet by arranging the coiled springs 17 to impose a load of about 6 N (600 gf) on each side of the curl correction means 10. However, this numerical value is not mandatory and the invention is not limited to this value. The value may be variously set according to the arrangement and materials of component parts.

As described above, in the curl correction means 10 in the first embodiment, the pressing roller 13 is pressed by means of the coiled springs 17 to move in the direction of pressing the endless belts 14 and also in the direction of being released from pressing the endless belts 14. Therefore, the amount of ingression of the pressing roller 13 to the endless belts 14 varies with the variation of the reaction force based on the thickness (rigidity) of the sheet P. In a case where the sheet P is the normal sheet, the ingressing amount of the pressing roller 13 is large to increase a curl correcting power. If the sheet P is the thick sheet, on the other hand, the ingressing amount of the pressing roller 13 is caused to become smaller by the relatively large reaction force of the sheet P to make the curl correction power smaller. By this, the curl correction can be optimized to permit utilization of both the advantage of the normal sheet and that of the thick sheet.

Further, in the curl correction means 10 in the first embodiment, the coiled spring 17 is arranged on each of the two ends of the pressing roller 13 to press the two ends independently of each other. Therefore, the tension of the endless belts 14 can be kept approximately constant at the two ends to stabilize the curl correcting function irrespectively of the dimensional precision of the driving belt shaft 12, the driven belt shaft 11, the belt conveying rollers 11*a* and 12*a* and the endless belts 14.

A second embodiment of the invention is next described below with reference to FIGS. 6, 7 and 8. In the description of the second embodiment, all parts that are the same as those of the first embodiment are denoted by the same reference numerals as those used for the first embodiment, and the details of them are omitted from the description.

Figure 6:
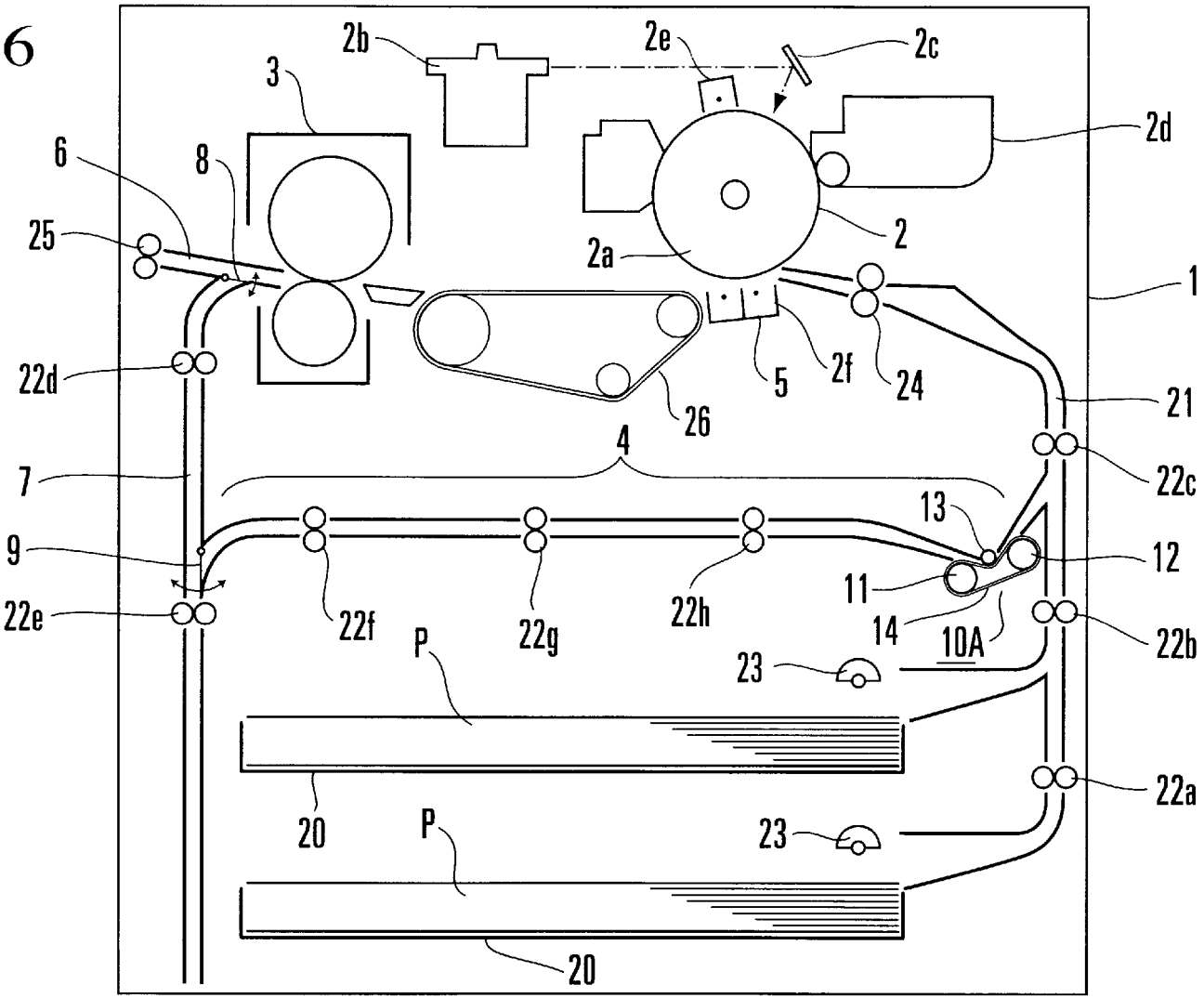
FIG. 6 is a sectional view showing the whole arrangement of an image forming apparatus according to a second embodiment of the invention.
Figure 7:
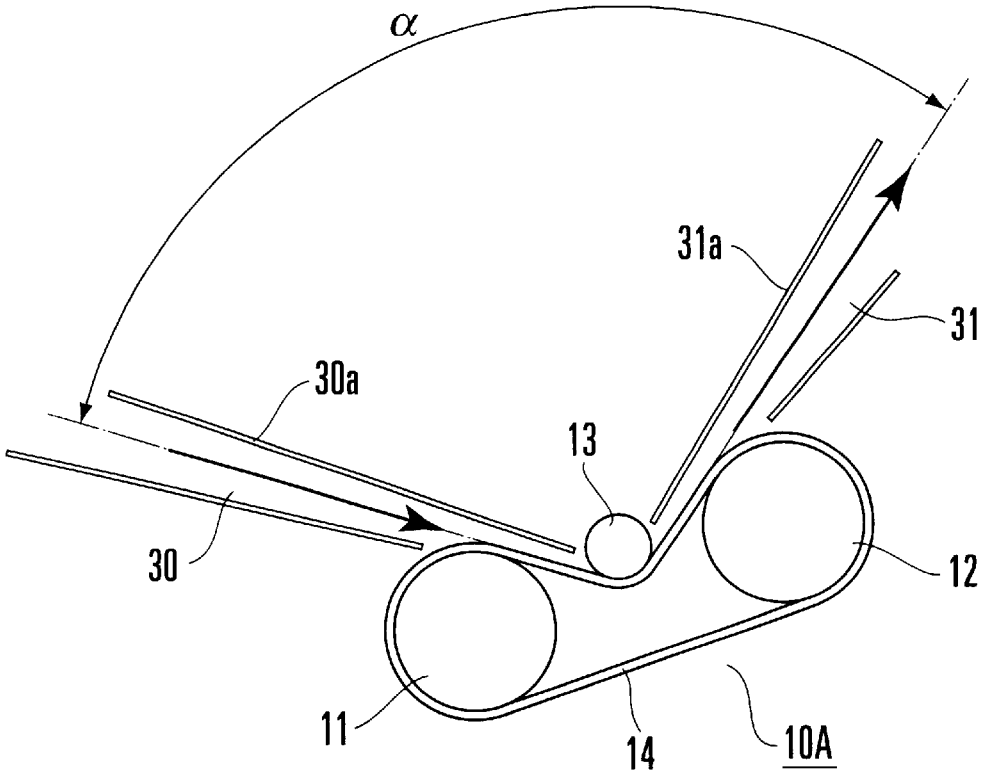
FIG. 7 is a side view for explaining an angle which the upper surfaces of an endless belt formed with a pressing roller taken as a boundary therebetween make with each other in the curl correction means.

In the image forming apparatus according to the second embodiment, as shown in FIG. 6, a curl correction means 10A which is similar to the curl correction means 10 in the first embodiment is disposed at a bent path part located in the neighborhood of the exit part of the two-sided-print conveying path 4. As shown in FIG. 7, at the curl correction means 10A in the second embodiment, an angle a which the upstream-side conveying path 30 and the downstream-side conveying path 31 of the sheet conveying surface with the pressing roller 13 taken as a boundary therebetween make with each other in the initial state in which no sheet passing there is arranged to be within the range of "$2\pi/6$ (rad) $\leqq\alpha\leqq 5\pi/6$ (rad)", i.e., to be not less than 60 degrees and not greater than 150 degrees.

The pressing roller 13 is disposed on the end sides of upper guide members 30*a* and 31*a* and in the neighborhood of an intersection point between the upstream-side conveying path 30 and the downstream-side conveying path 31.

Figure 8:
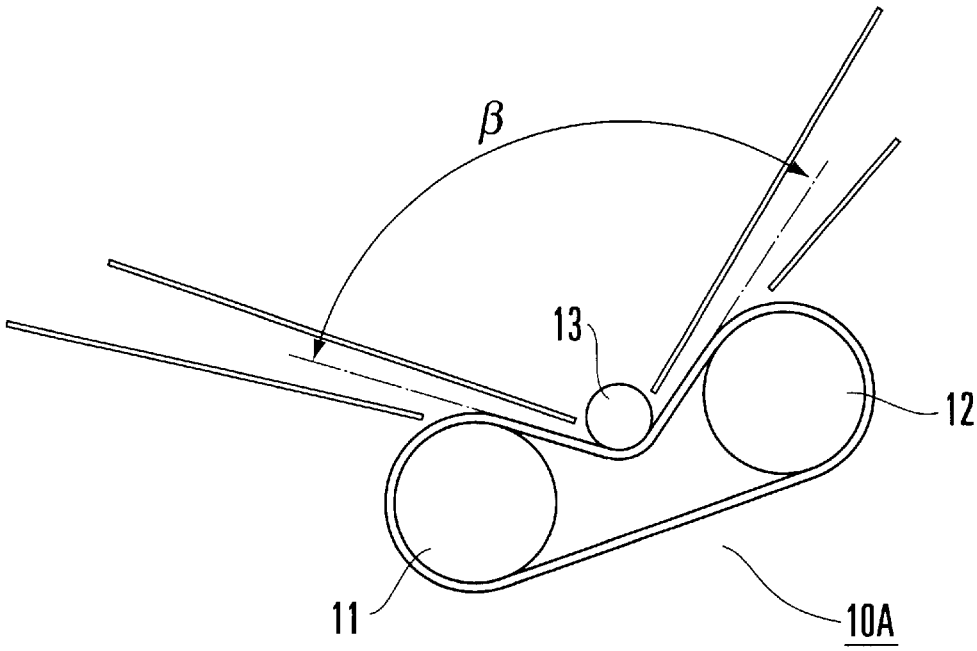
FIG. 8 is another side view for explaining an angle which the upper surfaces of the endless belt formed with the pressing roller taken as a boundary therebetween make with each other in the curl correction means.

Further, as shown in FIG. 8, an angle $\beta$ which the pressing roller 13, the endless belt 14, the driving belt shaft 12 and the driven belt shaft 11 make with each other is an angle bending in the same direction as the angle $\beta$, and is arranged to be "$\beta=\alpha\pm\pi/6$",which is about the same as the angle $\alpha$.

With the curl correction means 10A arranged in this manner, the arrangement enables the sheet P to smoothly ingress into an approximately-V-shaped conveying path part formed jointly by the endless belt 14 and the pressing roller 13 and also to be smoothly delivered. The arrangement minimizes the possibility of causing the sheet P to receive a force in the direction opposite to the curl correcting direction before and after the V shape path part of the curl correction means 10A, so that the curl correction function can be more efficiently carried out.

The angle $\alpha$ which the upstream-side conveying path 30 and the downstream-side conveying path 31 make with each other is a value, as mentioned above, obtained in the initial state in which no sheet is passing. In a case where the sheet P to be passed is the thick sheet, a relatively large reaction force of the sheet P causes the pressing roller 13 to retreat to bring about a state of "$\alpha>5\pi/6$ (rad)", which brings about no problem.

Further, in the case of the second embodiment, the curl correction means is set at "$\alpha=7\pi/12$ rad (105°)" and "$\beta=11\pi/18$ rad (110°)". However, the advantageous effect of the invention may be attainable by setting the curl correction means at a wider range, which is not less than "$\alpha=2\pi/6$ (rad)" and not greater than "$5\pi/60$ (rad)", and "$\beta=\alpha\pm\pi/6$".

In the case of each of the first and second embodiments described above, the invention is applied to a printer. However, the invention is not limited to a printer but is of course applicable also to a copying machine, a facsimile apparatus and a composite apparatus which is composed of these apparatuses. As for the image forming process, the invention is not limited to the electrophotographic image forming process but is applicable also to an ink jet process and other kinds of process.

According to the arrangement of the first and second embodiments described above, a sheet conveying device capable of making curl correction according to the thickness of the sheet and an image forming apparatus having the sheet conveying device can be formed without increasing cost and size.

A third embodiment of the invention is described below with reference to FIGS. 9 to 13.

Figure 9:
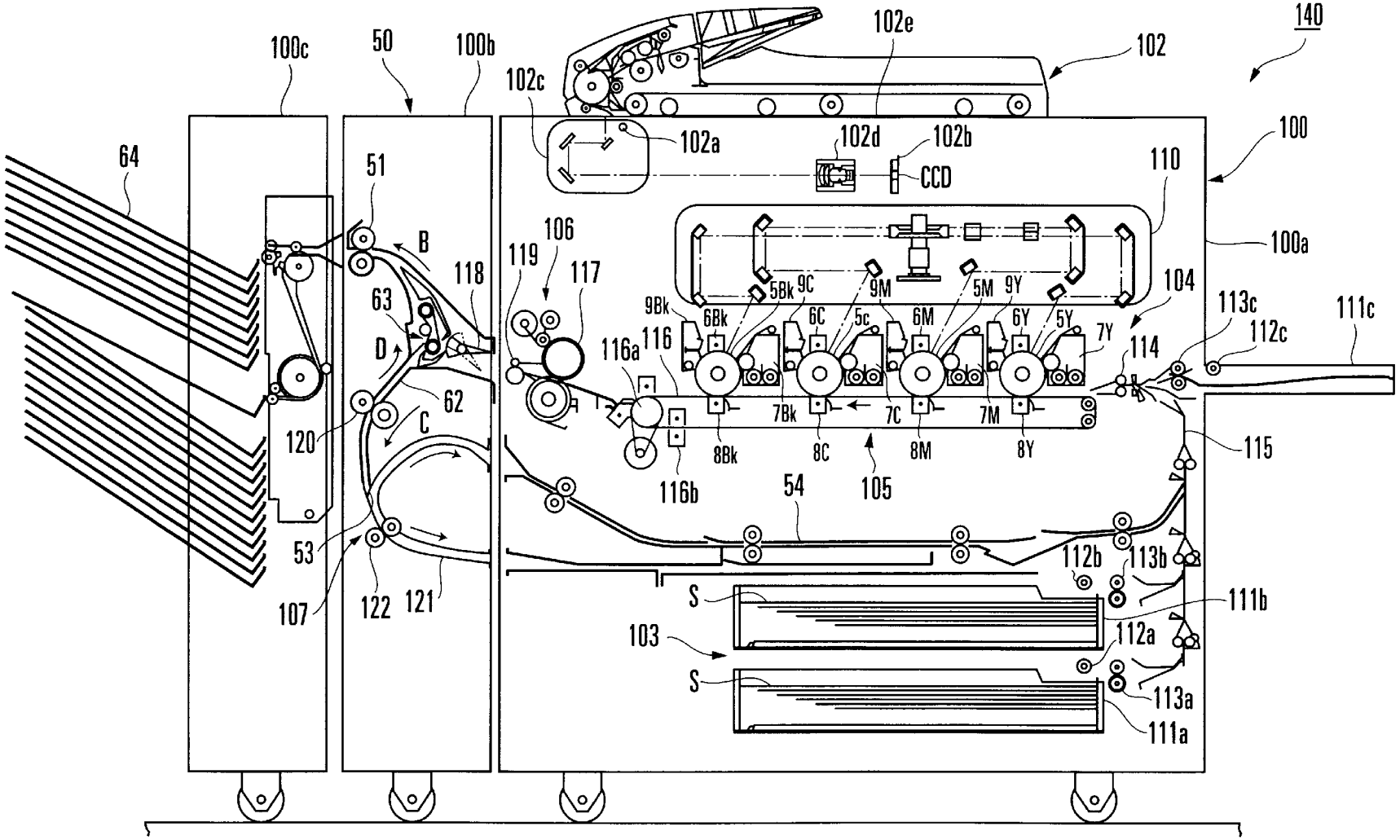
FIG. 9 is a front schematic sectional view showing the arrangement of an image forming apparatus provided with a curled-sheet correction device according to a third embodiment of the invention.
Figure 10:
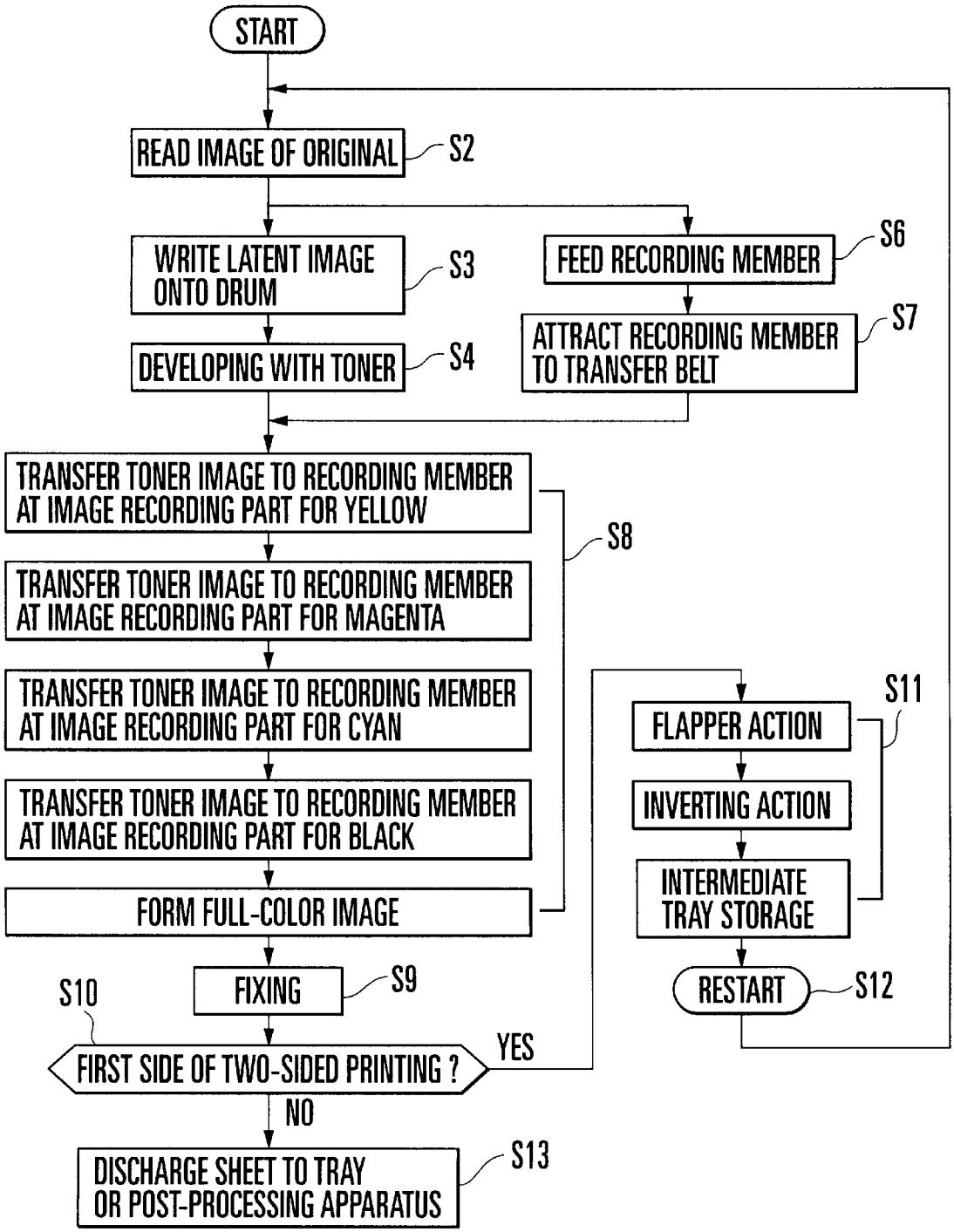
FIG. 10 is a flow chart showing an operation of the image forming apparatus shown in FIG. 9.

A printer representing, by way of example, the image forming apparatus having a curled-sheet correction device according to the third embodiment of the invention is first described referring to FIGS. 9 and 10. The curled-sheet correction device is next described referring to FIGS. 11, 12 and 13.

Referring to FIG. 9, the body 100 of the printer 140 is divided into three parts, i.e., a first body 100*a*, a second body 100*b* and a third body 100*c*. The body 100, however, may be formed in one body without dividing it. The essential parts of the printer 140 are disposed in the first body 100*a*. The curled-sheet correction device 50 is disposed in the second body 100*b*. A post-processing apparatus, such as a stapler, a puncher, or the like, which is not shown, is disposed in the third body 100*c*.

The first body 100*a* includes a reader part 102 arranged to read an original to be copied, a sheet supply part 103 arranged to supply sheets S, an image recording part 104 arranged to turn information on the original into a toner image by an electrophotographic process, a transfer part 105 arranged to transfer the toner image onto the sheet S supplied thereto, a fixing-and-delivery part 106 arranged to fix the toner image to the sheet S and to deliver the sheet S, and a part of an inverse conveying part 107 arranged to invert and convey the sheet S. Image forming means is formed jointly by the image recording part 104 and the transfer part 105.

The reader part 102 includes an original-placing bard 102*e*, a light source 102*a* arranged to illuminate the original with light, a mirror unit 102*c* and a lens unit 102*d* which are arranged to lead reflection light from the original to a CCD 102*d*, and the CCD 102*d*, which is arranged to convert the reflection light from the original into an electrical signal.

The sheet supply part 103 includes cassette parts 111*a* and 111*b*, sheet supply rollers 112*a* and 112*b* arranged to send sheets S out from the cassette parts 111*a* and 111*b*, pairs of sheet separating rollers 113*a* and 113*b* arranged to prevent the sheets S from being sent out in a state of overlapping each other, a sheet conveying part 115 arranged to forward the sheets S from the cassette parts 111*a* and 111*b* to the transfer part 105, a manual feed part 111*c* arranged to permit manual feeding of a sheet S, a sheet supply roller 112*c* arranged to feed the sheet S from the manual feed part 111*c*, a pair of separating rollers 113*c* arranged to prevent the sheets S from being fed in a state of overlapping each other, and a pair of registration rollers 114 arranged to adjust the timing of feeding the sheets S.

The image recording part 104, which converts information obtained from the original into a toner image by an electrophotographic process, includes photosensitive drums 5Y, 5M, 5C and 5Bk which correspond respectively to yellow, magenta, cyan and black colors, a polygonal mirror arranged to scan laser beams coming from a laser beam emitting device (not shown), a mirror unit 110 arranged to lead the laser beams from the polygonal mirror to the photosensitive drums, primary chargers 6Y, 6M, 6C and 6Bk arranged to electrify and charge the photosensitive drums 5Y, 5M, 5C and 5Bk, developers 7Y, 7M, 7C and 7Bk arranged to make latent images on the photosensitive drums visible with toners, and cleaners 9Y, 9M, 9C and 9Bk arranged to remove remnant toners left sticking to the photosensitive drums 5Y, 5M, 5C and 5Bk.

The transfer part 105, which transfers the toner images to the sheets supplied there, includes a transfer belt 116 arranged to convey the sheet S by attracting the sheet S, a driving roller 116*a* arranged to drive the transfer belt 116, a charger 116*b* arranged to electrify the transfer belt 116, and transfer chargers 8Y, 8M, 8C and 8Bk arranged to transfer the toner images on the photosensitive drums to the sheet S.

The fixing-delivery part 106, which fixes the toner images to the sheet S and delivers the sheet S, includes a pair of fixing-and-pressing rollers 117 arranged to fix the toner image to the sheet S at the nip part where the pair of fixing-and-pressing rollers 117 are pressed against and come into contact with each other, a pair of sheet delivery rollers 119 arranged to deliver the sheet S having the toner image fixed thereto, etc.

The inverse conveying part 107 is arranged across the boundary between the first body 100*a* and the second body 100*b*, and includes a flapper 118 which is arranged to switch the destination of the sheet S between the direction of sheet delivery (indicated by an arrow B) and the direction of inverse conveying (indicated by an arrow C), a conveying path 62, an inverse conveying path 121 arranged to upside-down invert the sheet S, a pair of conveying rollers 120 and a pair of inverting rollers 122 arranged to conversely have their rotating directions, a horizontal conveying path 54 arranged within the first body 100*a* to convey the upside-down inverted sheet S from the inverse conveying path 121 to the sheet conveying path 115, etc.

An operation of the printer 140 is described below with reference to FIG. 10, which is a flow chart.

With an original placed on the original-placing board 102*e*, when a start key (not shown) is pushed by the user, the light source 102*a* and the mirror unit 102*c* move along the surface of the original. At step S2, reflection light from the original is led to the CCD 102*b* by the mirror unit 102*c* and the lens unit 102*d*. The CCD 102*b* reads the original by serially converting image signals of the reflection light into an electrical signal.

At step S3, the image signal converted into the electrical signal is sent to a laser beam emitting device (not shown) to control the laser beam emission accordingly. The laser beams corresponding to the image signal are used for scanning by the polygonal mirror. The mirror unit 110 then illuminates the photosensitive drums 5Y, 5M, 5C and 5Bk of the image recording part 104 with the result of scanning made by the polygonal mirror, to obtain latent images on them.

At step S4, the photosensitive drums 5Y, 5M, 5C and 5Bk rotate clockwise as viewed in FIG. 9. The latent images on the photosensitive drums 5Y, 5M, 5C and 5Bk are made to be visible by the developers 7Y, 7M, 7C and 7Bk as toner images.

Meanwhile, at step S6, the sheet S sent out from one of the cassette parts 111*a* and 111*b* or the manual feed part 111*c*, which has been selected either by setting it beforehand or automatically selected by prescanning the original, is fed to the registration roller pair 114 through the sheet conveying path part 115.

At step S7, after timing adjustment to the image signal, the sheet S is fed to the transfer belt 116. The transfer belt 116 is caused to revolve by the driving roller 116*a* at a speed a little slower than the speed of feeding by the registration roller pair 114. The sheet S is then attracted by the surface electric charge of the transfer belt 116 imparted by the charger 116*b*.

At step S8, the sheet S attracted by the transfer belt 116 is conveyed in synchronism with the image signal on the photosensitive drums 5Y, 5M, 5C and 5Bk. The sheet S on the transfer belt 116 is brought into contact first with the photosensitive drum 5Y to transfer an yellow toner image on the photosensitive drum 5Y to the sheet S by means of the transfer charger 8Y. After that, the toner images of magenta, cyan and block colors are likewise transferred at the other photosensitive drums 5M, 5C and 5Bk one after another to form a full-color image on the sheet S. Then, the flow proceeds from the step S8 to step S9. At the step S9, the toner image on the sheet S is sent to the fixing-delivery part 106. At the part 106, the toner image is fixed through the nip part of the fixing-and-pressing roller pair 117 by heating and pressing.

At the next step S10, the flow of operation forks into two different sequences of processes according to whether the printing is to be made only on one side of the sheet S or on two sides of the sheet S.

In the case of printing on two sides of the sheet S, the flow proceeds from the step S10 to step S11. At the step S11, the sheet S is sent by the flapper 118 to the inverse conveying part 107. At the inverse conveying part 107, the conveying roller pair 120 sends the sheet S to the inverting roller pair 122. The inverting roller pair 122 reversely rotates in the neighborhood of the rear end of the sheet S to send the sheet S toward the conveying roller pair 120. At step S12, the sheet P thus sent comes to the horizontal conveying path 54 to have an image formed on the remaining unprinted side thereof, so that the sheet S is eventually delivered.

If the sheet S is to be printed only on one side thereof, or after the completion of printing on both sides thereof, the flow proceeds from the step S10 to step S13. At the step S13, the sheet S is sent from the sheet delivery roller pair 119 through the switching action of the flapper 118 to the sheet delivery roller pair 51 to be delivered either to the sheet delivery tray 64 or, in some case, to the post-processing apparatus, such as a stapler, a puncher or the like, so that the sheet S is eventually delivered to the sheet delivery tray 64.

Figure 11:
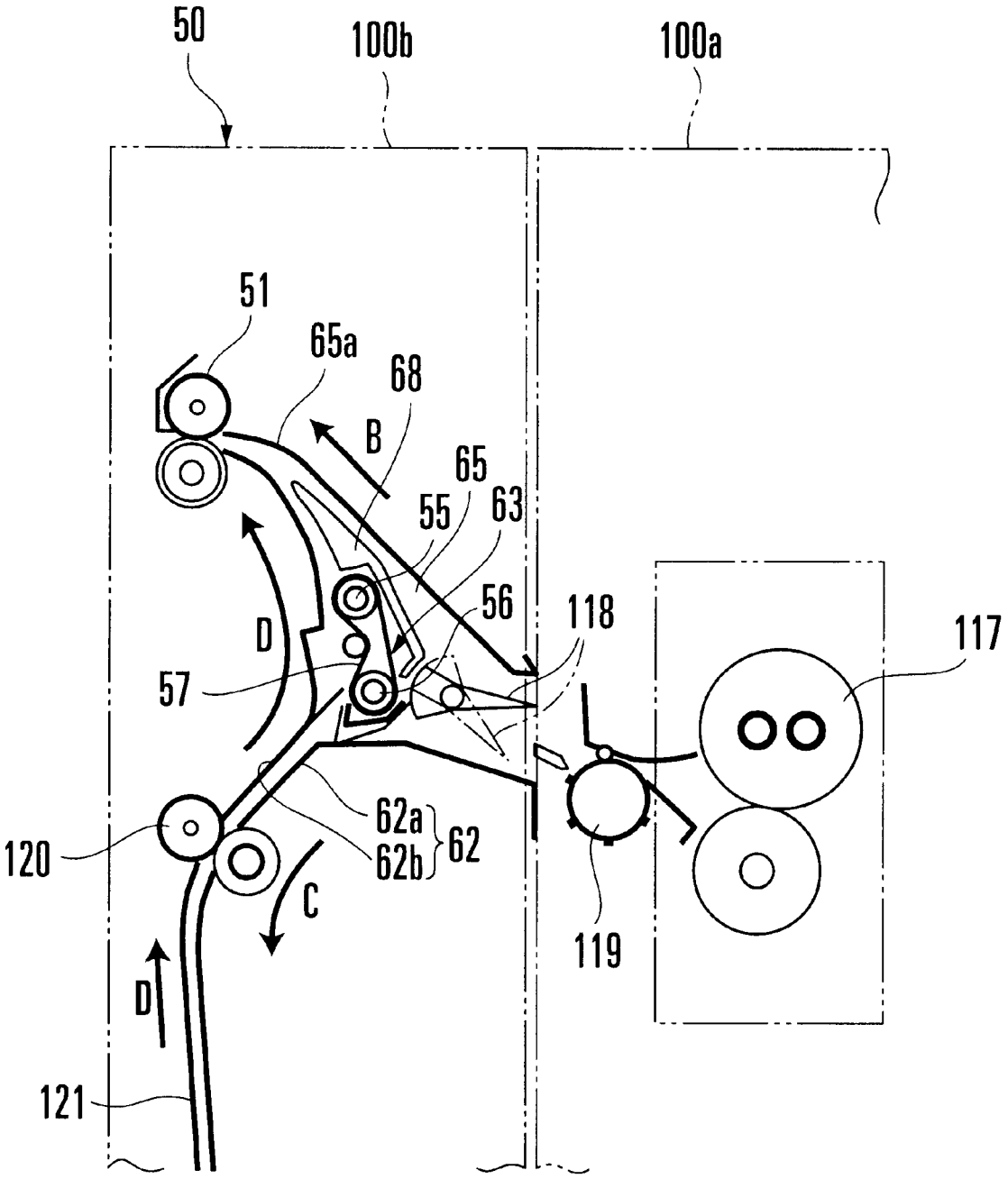
FIG. 11 is a detail view showing the essential parts of the curled-sheet correction device shown in FIG. 9.
Figure 12:
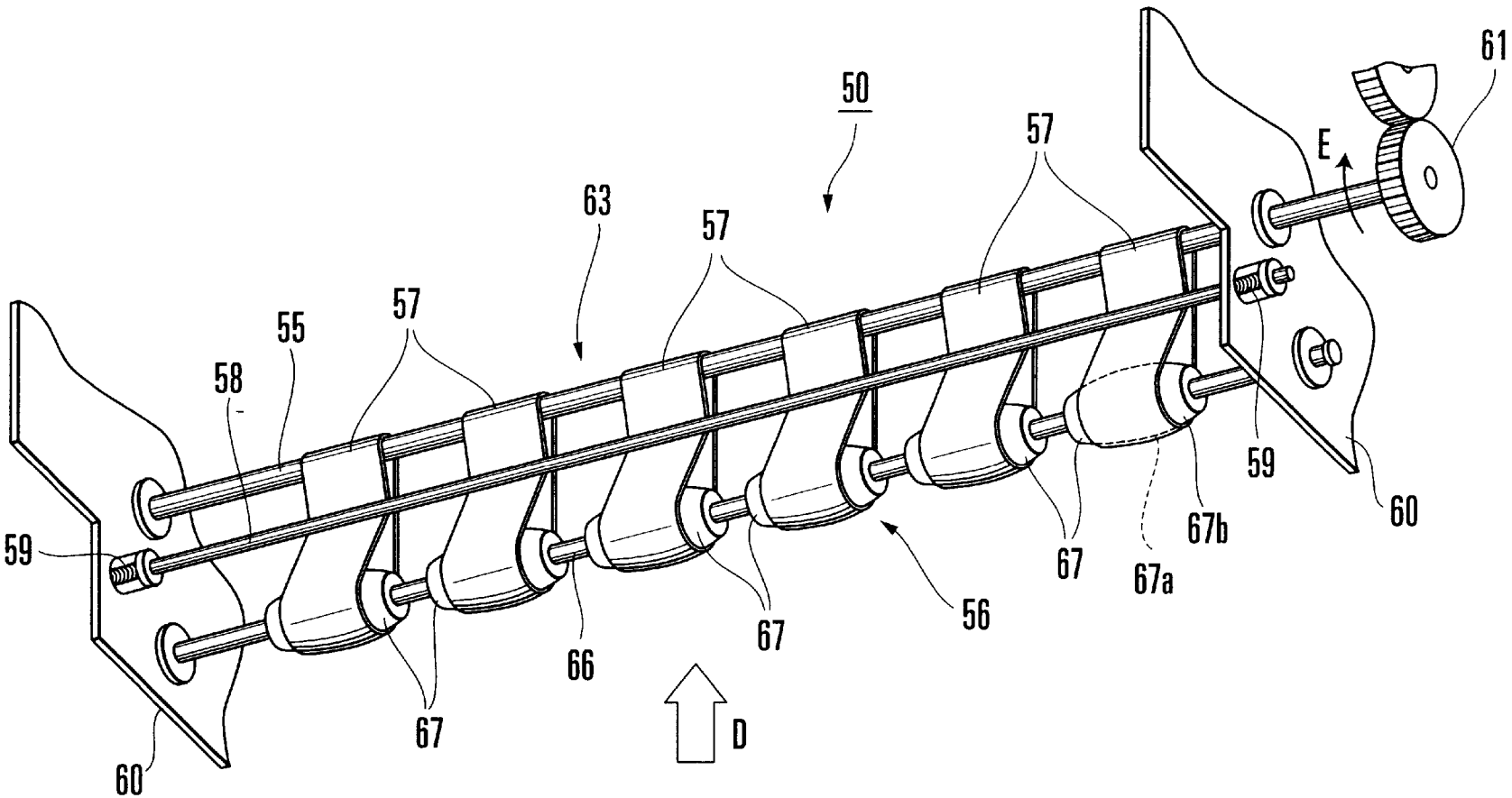
FIG. 12 is a perspective view showing the essential parts of the curled-sheet correction device shown in FIG. 9.
Figure 13:
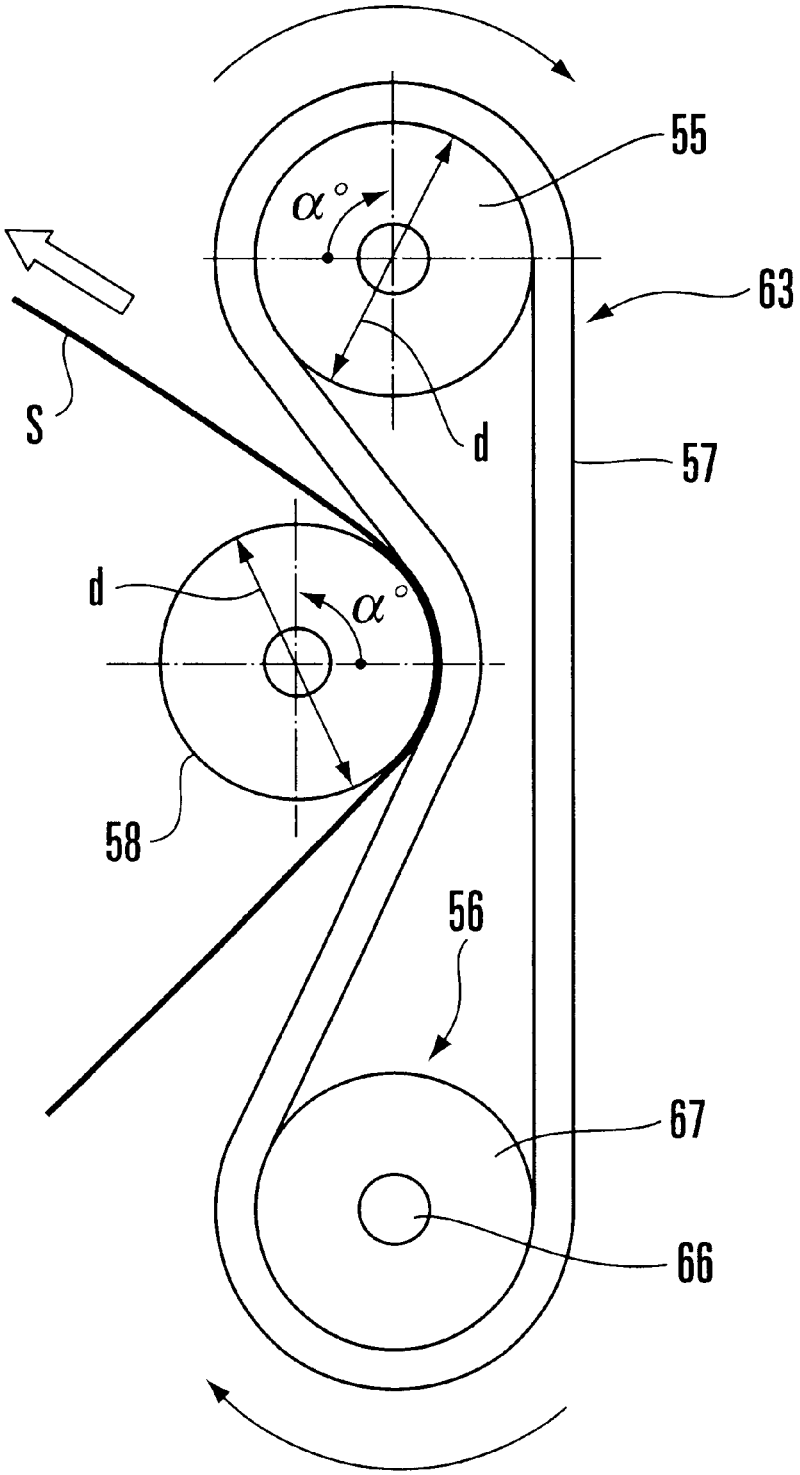
FIG. 13 is a sectional view showing the essential parts of the curled-sheet correction device shown in FIG. 9.
Figure 14:
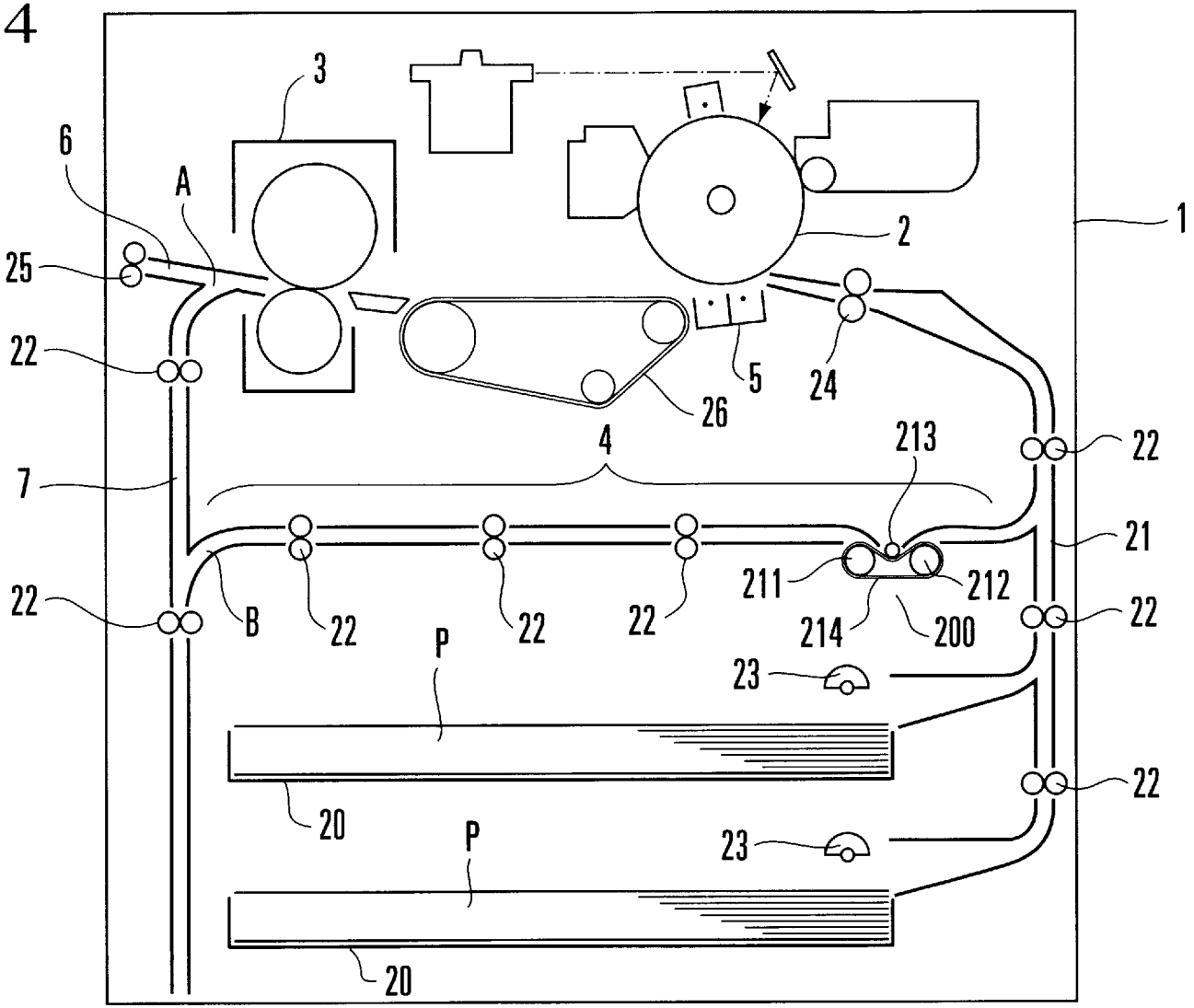
FIG. 14 is a sectional view showing the whole arrangement of a conventional image forming apparatus having a two-sided printing function.
Figure 15:
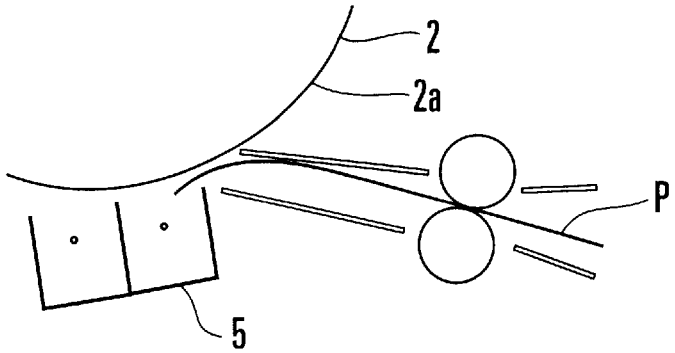
FIG. 15 is a diagram for explaining a case where inadequate transfer takes place.
Figure 16:
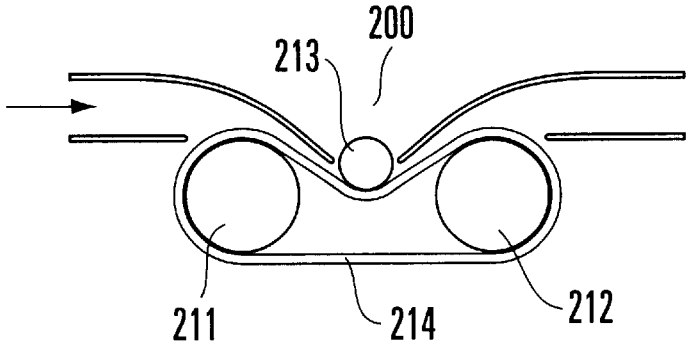
FIG. 16 is a diagram for explaining the arrangement of a curl correction mechanism.
Figure 17:
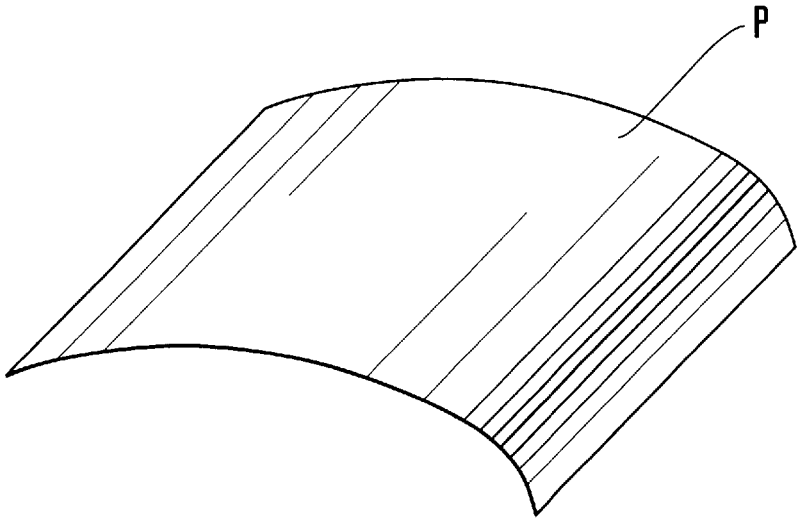
FIG. 17 is a diagram showing a sheet in a curled state.
Figure 18:
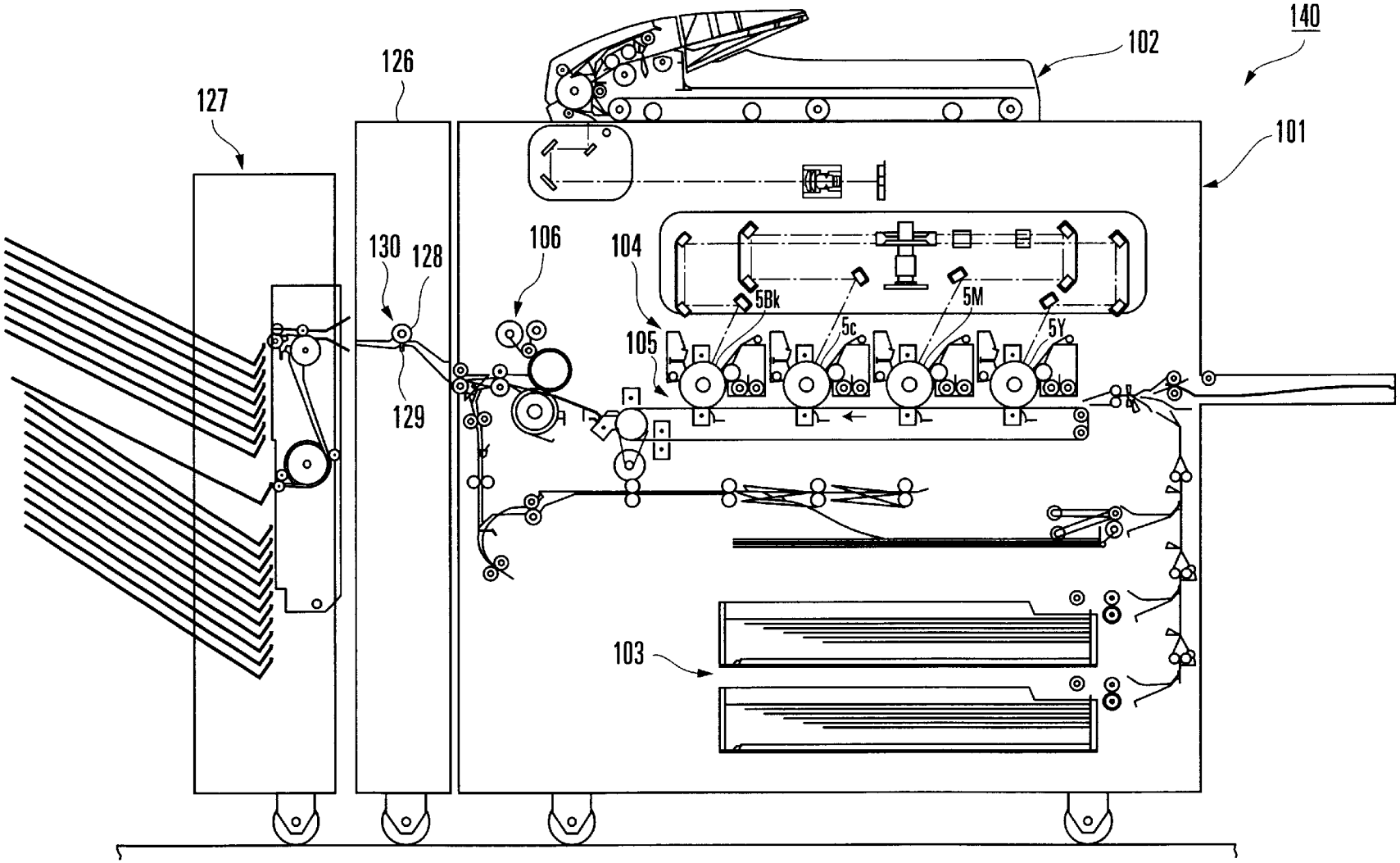
FIG. 18 is a front schematic sectional view showing in outline the arrangement an image forming apparatus having a conventional curled-sheet correction device.
Figure 19:
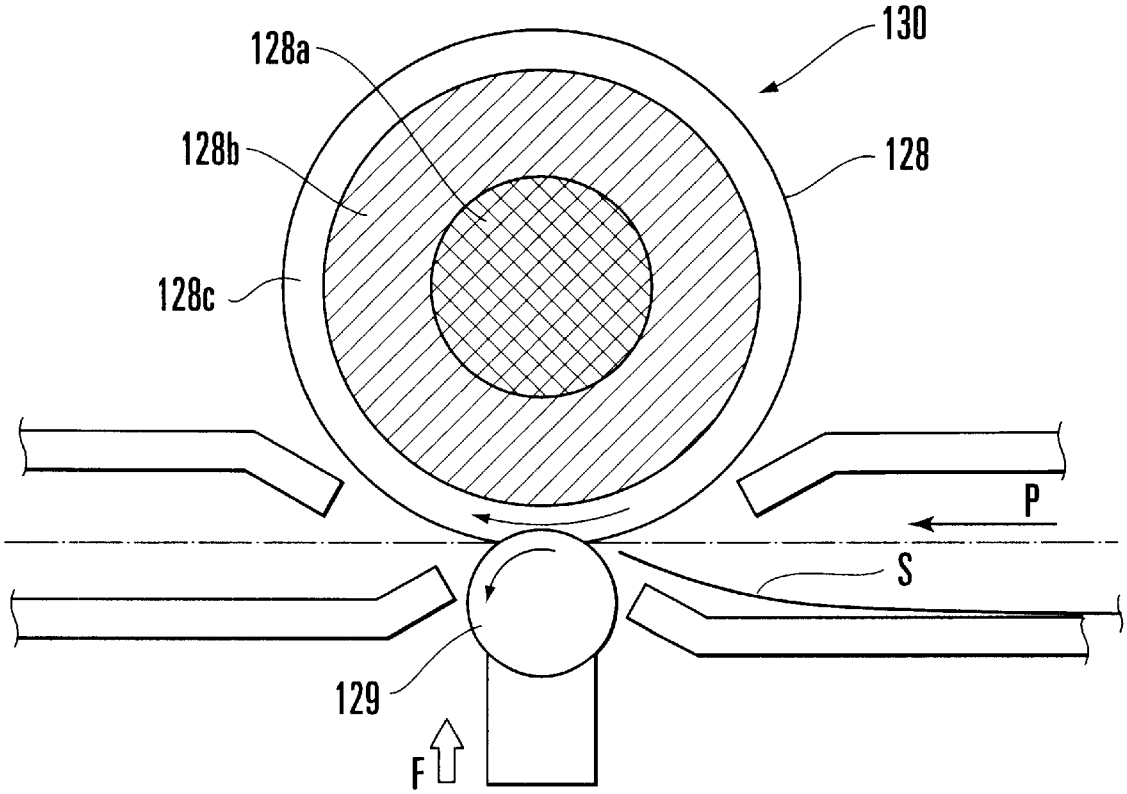
FIG. 19 is an enlarged view showing essential parts of the curled-sheet correction device shown in FIG. 18.

FIG. 11 is a sectional view showing in outline the curled-sheet correction device 50. FIG. 12 is a perspective view of a curled-sheet correction part 63. FIG. 13 is a sectional view of the curled-sheet correction part 63.

The curled-sheet correction device 50 functions to correct a curled sheet and also to change the sheet delivery direction from one direction over to another. The fixing-delivery part 106 included in the printer 140 has a characteristic of imparting a downward curl to the sheet S. In cases where the sheets S are to be stacked on the delivery tray 64 and where the sheets S are to be processed by the post-processing apparatus, a downward curl makes a sheet handling process easier than an upward curl. An upward curl is, therefore, corrected into a downward curl in many cases.

Referring to FIG. 11, in a case where the sheet S is to be delivered in the direction of an arrow B, the curled-sheet correction device 50 operates as follows. Each of the sheets S passes through the fixing-delivering part 106, is sent out by the sheet delivery roller pair 119, is selectively led by the flapper 118 in the direction of the arrow B, passes through the conveying path 65, and is delivered by the sheet delivery roller pair 51 either to the outside of the apparatus or to the post-processing apparatus (not shown). In this case, since the sheet S has been curled downward, the sheet S never passes through the curled-sheet correction part 63.

Next, in a case where the sheet S is to be delivered in the direction of an arrow C, the curled-sheet correction device 50 operates as follows. The conveying path 62 and the inverse conveying path 121 are provided for printing on two sides of the sheet S. The sheet S is sent out by the delivery roller pair 119 after passing through the fixing-delivery part 106. The flapper 118 then acts to selectively lead the sheet S in the direction of the arrow C. After that, the sheet S is led to the conveying path 121 through the conveying roller pair 120, which is arranged to be capable of rotating forward and backward. The sheet S then reaches the inverting roller pair 122. The sheet S is conveyed further to have its moving direction switched backward by the inverting roller pair 122, which comes to reversely rotate when the rear end of the sheet S pass an inverting sheet 53 which is made of a plastic sheet. After the switchback, the sheet S is led to the horizontal conveying part 54 by the inverting sheet 53 and is fed to the image recording part 104 to have an image formed on its second side.

In a case where the sheet S is to be conveyed in the direction of an arrow D after the sheet S is temporarily conveyed in the direction of the arrow C, the curled-sheet correction device 50 operates as follows. In this case, a conveying path is arranged to be used for delivering the sheet S in a state of having its image side facing downward.

The curled-sheet correction part 63 includes a driving roller (driving guide roller) 55, a driven roller 56, endless belts 57 which are wrapped around the rollers 55 and 56 and are made of a rubber material, and a pressing roller (curl correction roller) 58 which is arranged to press each endless belt 57 to form a curl correction nip.

The driving roller 55 has a straight generatrix and is in an exactly cylindrical shape. The driving roller 55 is thus arranged to make a circumferential speed of the endless belts 57 accurately computable from its rotational frequency. The driven roller 56 is formed with six cylindrical members 67 mounted on a rotation shaft 66. The cylindrical members 67 are provided for preventing the six endless belts 57 from being decentered. For this purpose, each of the cylindrical members 67 is formed in a crowned shape (drum-like shape) arranged to have its diameter larger at its middle part 67*a* than at its two ends 67*b*. The two ends of the pressing roller 58 are urged by the pressing springs 59 in the direction of warping the endless belts 57. The pressing roller 58 is thus arranged to press the endless belts 57 in the direction of narrowing their circulating areas. The rollers 56 and 58 are supported by frames 60 in a rotatable manner. The driving roller 55 is arranged to receive through a gear 61 a rotative driving force from a motor (not shown) which is employed as a drive source.

A downward curl is imparted to the sheet S by the fixing-delivery part 106. Therefore, in a case where the sheet S is to be inverted upside-down by conveying the sheet P in the direction of the arrow D, the sheet S would be delivered in an upward curled state if no correcting action is performed on the sheet S.

In a case where the sheet S is allowed to travel in the direction of the arrow D, the driving roller 55 is rotating in the direction of an arrow E. The sheet S is then guided by guides 62*a* and 62*b* to come into the nip part between the pressing roller 58 and each of the endless belts 57. At the nip part, a curved path part is formed jointly by the pressing roller 58 and each endless belt 57. With the sheet S having passed through this curbed path part, the upward curl of the sheet S is curled downward to flatten the sheet S. The uncurled sheet S is guided by a guide 62*b*, a guide piece 68 and a guide 65*a* and is led to the delivery roller pair 51 to be either delivered to the outside of the image forming apparatus or to the post-processing apparatus.

The relation of the circumferential speed of the belt to a sheet conveying speed is next described with reference to FIG. 13. For the sake of simplification, the diameter $\phi d$ of the driving roller 55 is assumed to be equal to that of the pressing roller 58. Referring to FIG. 13, with the driving roller 55 rotated to an angle $\alpha°$, the inner circumferential progressing distance L of each of the endless belts 57 at the driving roller 55 can be expressed as follows: $L=d\cdot\pi\cdot(\alpha/360)$ The outer circumferential progressing distance of the endless belt 57 at the pressing roller 58 also becomes L. Therefore, without taking into consideration the thickness of the sheet S, the advancing distance of the sheet S becomes the same as the moving distance of the periphery of the driving roller 55.

In other words, a speed at which the sheet S is conveyed at the curled-sheet correction part 63 becomes the same as the circumferential speed of the driving roller 55. Therefore, in a case where there is any desired sheet conveying speed, the desired speed can be attained by setting the circumferential speed of the driving roller 55 at the same speed as the desired speed.

If the diameter of the driving roller 55 differs from that of the pressing roller 58, the desired sheet conveying speed can be obtained by correcting the circumferential speed of the driving roller 55 to such an extent that corresponds to the difference in diameter.

The curled-sheet correction device 50 may be arranged to have a plurality of pressing rollers 58.

In the curled-sheet correction device 50 in the third embodiment, the driving roller 55 is allocated on the downstream side in the sheet conveying direction with reference to the driven roller 56. With the driving roller 55 allocated in this manner, the pressing roller 58 is arranged on the tension side of the endless belts 57. By virtue of this arrangement, the fluctuations of the amount of ingression (pushing-in amount) on the endless belts 57 in relation to variations of load resulting from the ingression of the sheet S can be lessened to stabilize the sheet conveying speed.

Further, in the case of the third embodiment, thin rubber belts are used as the endless belts 57. The use of the thin rubber belts effectively lessens the driving torque of the driving roller 55 as the amount of energy required in deforming the belts is much smaller than an amount of energy required in deforming a sponge roller like in the case of the conventional arrangement.

The curled-sheet correction device in the third embodiment uses the curled-sheet correction part 63 including in combination the driving roller 55, the driven roller 56, the endless belts 57 which are wrapped around the rollers 55 and 56, the pressing roller 58 arranged to press the endless belts 57 and a driving device which rotatively drives the driving roller 55. Since the driving torque is arranged to be small, the driving device can be arranged at low cost. Since the generatrix of the driving roller 55 of the curled-sheet correction part 63 is arranged to be straight, the sheet S can be conveyed at a stable and constant speed, so that the sheet S can be sent out accurately at a desired speed.

The curled-sheet correction device in the third embodiment includes the endless belts which are arranged to circulate in a state of being wrapped around a plurality of guide rollers, and at least one curl correction roller which is arranged to press the endless belts in the direction of narrowing their circulating areas. Of the plurality of guide rollers, the driving guide roller which is arranged to receive a rotative driving force is formed to have a straight generatrix. Therefore, the sheet can be sent out exactly at a desired speed to bring about almost no fluctuation in the sheet conveying speed.

In the curled-sheet correction device in the third embodiment, since the curl correction roller is arranged to press the tension side of the endless belts, the fluctuations of the amount of ingression of the curl correction roller on the endless belts 57 in relation to variations of load resulting from the ingression of the sheet S into the nip part between the curl correction roller and each of the endless belts can be lessened to stabilize the sheet conveying speed.

In the curled-sheet correction device in the third embodiment, the curl correction roller is arranged to press the endless belts on their tension side, i.e., on their stretched side, while the driving guide roller is arranged at the most downstream part in the sheet conveying direction. The allocation of the driving guide roller permits arranging the curl correction roller on the tension side of the endless belts, so that fluctuations in amount of ingression of the curl correction roller on the endless belts 57 in relation to variations of load due to the ingression of the sheet S in between the curl correction roller and each of the endless belts can be lessened to stabilize the sheet conveying speed.

The image forming apparatus in the third embodiment is provided with the curled-sheet correction device which is arranged, as described above, to be capable of sending out the sheet exactly at a desired speed. The image forming apparatus is, therefore, capable of supplying sheets having images formed thereon, without causing any jamming of sheets.

What is claimed is:

1. A sheet conveying device, comprising:

an endless belt for conveying a sheet;

at least two rollers arranged to support said endless belt;

a rotatable pressing roller arranged to push said endless belt from outside, the sheet being conveyed in a state of being pinched between said endless belt and said rotatable pressing roller; and an elastic member for pressing said rotatable pressing roller in a direction to push said endless belt, wherein said rotatable pressing roller is movable in a direction to separate from said endless belt.

2. A sheet conveying device according to claim 1, wherein said elastic member presses a rotation shaft of said rotatable pressing roller.

3. A sheet conveying device according to claim 2, wherein said elastic member is provided at each of two ends of the rotation shaft of said rotatable pressing roller.

4. A sheet conveying device according to claim 1, wherein an angle $\alpha$ which upstream-side and downstream-side sheet conveying surfaces of said endless belt formed with said rotatable pressing roller taken as a boundary therebetween make with each other is within the following range:

$$2\pi/6(\text{rad}) \leqq \alpha \leqq 5\pi/6(\text{rad}).$$

5. A sheet conveying device according to claim 4, wherein said rotatable pressing roller is located adjacent to an intersection point at which an upstream-side conveying path and a downstream-side conveying path are connected to each other.

6. A sheet conveying device according to claim 4, wherein an angle $\beta$ which said rotatable pressing roller, said endless belt and said stretching shafts make with each other is an angle bending in the same direction as the angle $\alpha$, and the angle $\alpha$ and the angle $\beta$ are in a relation satisfying the following condition:

$$\beta=\alpha\pm\pi/6.$$

7. An image forming apparatus, comprising:

a sheet conveying device comprising:

an endless belt for conveying a sheet;

at least two rollers arranged to support said endless belt;

a rotatable pressing roller arranged to push said endless belt from outside, the sheet being conveyed in a state of being pinched between said endless belt and said rotatable pressing roller; and an elastic member for pressing said rotatable pressing roller in a direction to push said endless belt, wherein said rotatable pressing roller is movable in a direction to separate from said endless belt; and image forming means for forming an image on a sheet conveyed by said sheet conveying device.

8. An image forming apparatus according to claim 7, further comprising:

a sheet housing part arranged to allow sheets to be stacked therein;

a sheet conveying path formed from said sheet housing part up to said image forming means; and a sheet resupply path arranged to supply to said image forming means again a sheet having an image formed thereon by said image forming means, wherein said sheet conveying device is disposed on said sheet resupply path.

9. An image forming apparatus according to claim 8, wherein said sheet resupply path has one end on a downstream side thereof connected to said sheet conveying path.

10. An image forming apparatus according to claim 8, wherein said sheet resupply path is provided with sheet inverting means for inverting a traveling direction of the sheet having an image formed thereon by said image forming means.

11. A curled-sheet correction device, comprising:

an endless belt arrange to circulate in a state of being wrapped around a plurality of guide rollers;

at least one curl correction roller arrange to press said endless belt in such a direction as to warp said endless belt; and pressing springs for urging said at least one curl correction roller in the direction of warping said endless belt, wherein, from among said plurality of guide rollers, a driving guide roller to which a rotative driving force is imparted is formed to have a straight generatrix, and curl of a curled sheet is corrected while the curled sheet is conveyed jointly by said endless belt and said curl correction roller.

12. A curled-sheet correction device according to claim 11, wherein said curl correction roller is arranged to press a tension side of said endless belt.

13. A curled-sheet correction device according to claim 11, wherein said curl correction roller is arranged to press a tension side of said endless belt, and said driving guide roller is disposed on a most downstream side in a direction in which the sheet is conveyed.

14. A curled-sheet correction device according to claim 11, wherein, from among said plurality of guide rollers, a driven guide roller arranged to be driven to rotate has a larger diameter at a middle part thereof than at two end parts thereof.

15. An image forming apparatus, comprising:

image forming means for forming an image on a sheet; and a curled-sheet correction device comprising:

an endless belt arrange to circulate in a state of being wrapped around a plurality of guide rollers;

at least one curl correction roller arrange to press said endless belt in such a direction as to warp said endless belt; and pressing springs for urging said at least one curl correction roller in the direction of warping said endless belt, wherein, from among said plurality of guide rollers, a driving guide roller to which a rotative driving force is imparted is formed to have a straight generatrix, and curl of a curled sheet is corrected while the curled sheet is jointly conveyed by said endless belt and said at least one curl correction roller, said curled-sheet correction device being arranged to remove curl of the sheet having an image formed thereon by said image forming means.

16. An image forming apparatus, comprising:

image forming means for forming an image on a sheet;

two-sides inverting means for inverting two sides of the sheet having an image formed thereon by said image forming means and then discharging the sheet; and a curled-sheet correction device comprising:

an endless belt arrange to circulate in a state of being wrapped around a plurality of guide rollers;

at least one curl correction roller arrange to press said endless belt in such a direction as to warp said endless belt; and pressing springs for urging said at least one curl correction roller in the direction of warping said endless belt, wherein, from among said plurality of guide rollers, a driving guide roller to which a rotative driving force is imparted is formed to have a straight generatrix, and curl of a curled sheet is corrected while the curled sheet is jointly conveyed by said endless belt and said at least one curl correction roller, said curled-sheet correction device being disposed at said two-sides inverting means.

17. A sheet conveying device, comprising:

an endless belt arranged to convey a sheet;

at least two supporting rotary members arranged to support said endless belt;

a pinching rotary member arranged to pinch the sheet in conjunction with said endless belt; and an elastic member for warping said endless belt along a circumferential surface of said pinching rotary member by urging said pinching rotary member, wherein said pinching rotary member is supported in such a way as to be movable against an urging force of said elastic member by rigidity of the sheet pinched by said endless belt and said pinching rotary member.

18. A sheet conveying device according to claim 17, further comprising support means for movably supporting said rotary member urged by said elastic member.

* * * * *